US005444464A

United States Patent [19]

Endo

[11] Patent Number: 5,444,464

[45] Date of Patent: Aug. 22, 1995

[54] THERMAL PRINTER HEAD DRIVING CIRCUIT WITH THERMAL HISTORY BASED CONTROL

[75] Inventor: Takafumi Endo, Hyogo, Japan

[73] Assignee: Mitsubishi Denki Kabushiki Kaisha, Tokyo, Japan

[21] Appl. No.: 5,220

[22] Filed: Jan. 15, 1993

[30] Foreign Application Priority Data

| | | | |
|---|---|---|---|
| Jan. 20, 1992 | [JP] | Japan | 4-027480 |
| Mar. 23, 1992 | [JP] | Japan | 4-094942 |
| Apr. 16, 1992 | [JP] | Japan | 4-096221 |
| Oct. 8, 1992 | [JP] | Japan | 4-296332 |

[51] Int. Cl.[6] ..... B41J 2/365; B41J 2/36

[52] U.S. Cl. ..... 347/195; 67/11

[58] Field of Search ..... 346/76 PH; 400/120; 347/11

[56] References Cited

U.S. PATENT DOCUMENTS

| | | | |
|---|---|---|---|
| 3,975,707 | 8/1976 | Ito et al. | 346/76 PH |
| 4,305,080 | 12/1981 | Cunningham et al. | 346/76 PH |
| 5,346,318 | 9/1994 | Endo | 346/76 PH |
| 5,377,159 | 12/1994 | Endo | 346/76 PH |

FOREIGN PATENT DOCUMENTS

| | | |
|---|---|---|
| 0102375 | 6/1982 | Japan . |
| 0247065 | 10/1988 | Japan . |
| 64-1560 | 1/1989 | Japan . |

OTHER PUBLICATIONS

Ser. No. 07/952,254 Ketty filed Sep. 28, 1992.
Ser. No. 07/856,757 Tran filed Mar. 24, 1992.

*Primary Examiner*—Huan H. Tran
*Attorney, Agent, or Firm*—Rothwell, Figg, Ernst & Kurz

[57] ABSTRACT

Disclosed herein is a thermal head driving circuit for energizing a plurality of thermal resistors corresponding to a plurality of dots to thereby control a thermal head for printing data on a heat-sensitive paper. The thermal head driving circuit is provided with a plurality of latch circuits each of which retains recorded information formed of respective dots on the present line, of the plurality of dots and previous recorded information and outputs a plurality of patterns indicative of these information on a time-series basis. A pulse signal generator outputs pulse signals so as to increase the number of pulses with respect to patterns each falling under a high level when patterns that the degrees of increases in temperatures of said thermal resistors by energization based on patterns falling under different levels, of the plurality of patterns, are the same, are selected. The thermal resistors are energized based on the outputted pulse signals.

11 Claims, 24 Drawing Sheets

FIG. 4 (PRIOR ART)

| | CONTENTS OF LATCH DATA | | | POINT NUMBER INDICATIVE OF INCREASE IN TEMPERATURE |
|---|---|---|---|---|
| | Q3 | Q2 | Q1 | |
| LEVEL 1 | L | L | H | 1.0 |
| LEVEL 2 | H | L | H | 1.5 |
| | L | H | H | 2.0 |
| LEVEL 3 | H | H | H | 3.0 |

FIG. 14

| | CONTENTS OF LATCH DATA | | | | | POINT NUMBER INDICATIVE OF INCREASE IN TEMPERATURE |
|---|---|---|---|---|---|---|
| | Q5 | Q4 | Q3 | Q2 | Q1 | |
| LEVEL 1 | L | L | L | L | H | 1 |
| LEVEL 2 | H | L | L | L | H | 1 |
| | L | H | L | L | H | 1 |
| | L | L | H | L | H | 1.5 |
| | L | L | L | H | H | 2.0 |
| LEVEL 3 | H | H | L | L | H | 2.0 |
| | H | L | H | L | H | 2.0 |
| | H | L | L | H | H | 2.0 |
| | L | H | H | L | H | 2.5 |
| | L | H | L | H | H | 2.5 |
| | L | L | H | H | H | 3.0 |
| LEVEL 4 | H | H | H | L | H | 3.5 |
| | H | H | L | H | H | 3.5 |
| | H | L | H | H | H | 3.5 |
| | L | H | H | H | H | 4.0 |
| LEVEL 5 | H | H | H | H | H | 5.0 |

FIG. 10

| | CONTENTS OF LATCH DATA | | | | POINT NUMBER INDICATIVE OF INCREASE IN TEMPERATURE |
|---|---|---|---|---|---|
| | Q4 | Q3 | Q2 | Q1 | |
| LEVEL 1 | L | L | L | H | 1.0 |
| LEVEL 2 | H | L | L | H | 1.0 |
| | L | H | L | H | 1.5 |
| | L | L | H | H | 2.0 |
| LEVEL 3 | H | H | L | H | 2.5 |
| | H | L | H | H | 2.5 |
| | L | H | H | H | 3.0 |
| LEVEL 4 | H | H | H | H | 4.0 |

CASE OF PRINTING PATTERN (I)

CASE OF PRINTING PATTERN (L)

THERMAL PRINTER HEAD DRIVING CIRCUIT WITH THERMAL HISTORY BASED CONTROL

BACKGROUND OF THE INVENTION

1. Field of the Invention

The present invention relates to a thermal head driving circuit for driving a thermal head used as a printing unit employed in a facsimile system, a printer or the like.

2. Description of the Related Art

FIG. 1 is a circuit diagram showing a conventional one-dot type thermal head driving circuit. A thermal head has the thermal head driving circuit provided so as to correspond to a predetermined number of dots. In the same drawing, designated at numeral 1 is a shift register for shifting input data on the present line in accordance with a clock. The shift register 1 has the number of steps, which correspond to the number of dots for the thermal head. Reference numeral 21 indicates a latch circuit provided in plural form, for taking in data which appears at a tap of the shift register 1 so as to retain it therein. Designated at numeral 31 is a gate signal generator for generating three gate signals GA, GB, GC therefrom. Reference numerals 4*a*, 4*b* indicate inverted logical product (hereinafter called "NAND") gates supplied with the outputs of the latch circuit 21 and the gate signals GB, GC. Designated at numeral 51 is a logical product (hereinafter called "AND") gate provided in plural form, for outputting a pulse signal indicative of the state of energization. Further, reference numeral 6 indicates a darlington transistor (driving element) provided in plural form, for driving or energizing each heating or thermal resistor 7 in response to the input pulse signal.

The operation of the thermal head driving circuit will now be described below. The shift register 1 takes in data corresponding to an image signal in response to a clock signal and shifts it (see FIGS. 5(A) and 5(B)). The latch circuit 21 successively takes in data from a tap of the shift register 1, which corresponds to a dot thereof, in response to a latch signal. That is, when the latch signal is input once, the latch circuit 21 shifts the contents of the latch signal and brings data from the shift register 1. As a result, data on the previous line, which is formed of dots thereof, appears at the Q2 terminal and data on a line prior to the previous line, which is formed of dots thereof, appears at the Q3 terminal. Further, data on the present line, which will be printed from now, appears at the Q1 terminal.

The gate signal generator 31 generates the gate signals GA, GB, GC represented in the form of predetermined patterns as illustrated in FIGS. 5(D), 5(E) and 5(F), for example. A signal to be supplied to each thermal resistor 7 is determined by the gate signals, the NAND gates 4*a*, 4*b* and the AND gate 51. The darlington transistor 6 drives or energizes the corresponding thermal resistor 7 in response to the determined signal. Each thermal resistor 7 generates heat in proportion to the amount of current which flows therein, and brings a heat-sensitive paper or the like located on the thermal resistor 7 into color development.

A description will now be made of history control of the amount of current supplied to each thermal resistor 7. When a time interval required to energize the thermal resistor 7 is 1 ms as shown in FIG. 2(A), the temperature of the thermal resistor 7 is brought to 300° C. When, on the other hand, the energization of the thermal resistor 7 is repeated in a cycling period corresponding to 2 ms as shown in FIG. 2(B), the temperature of the thermal resistor 7 increases up to 500° C. That is, even if the same amount of current is supplied, the temperature of the thermal resistor 7 at the time of completion of the energization thereof increases if the temperature of the thermal resistor 7 at the start of the energization thereof is high. Thus, a color-developed density becomes high under the condition that the energization of each thermal resistor 7 is effected in a quick repeating cycle unless the energy supplied to the thermal resistor 7 is controlled, thereby causing printing unevenness. It is therefore necessary to control the amount of energy according to the temperature of each thermal resistor at the start of its energization. Described specifically, the control for the energization of each thermal resistor is effected based on a decision made as to whether or not desired data at a line prior to the previous line has been recorded.

This history control is effected in the following manner. That is, it is necessary to recognize the degree of an increase in temperature with respect to each of patterns (recorded conditions of dots on the present line, the previous line and the line prior to the previous line) in order to determine in what manner the energy should be supplied to dots on the present line judging from the recorded conditions of the dots on the previous line and the line prior to the previous line, in other words, the energization should be done with respect to the dots.

FIG. 3 is a simplified graph showing the result of simulation of increases in temperatures with respect to respective patterns at the time that the history control is not effected. In the same drawing, "H" represents that the recording (energization) of dots has been effected, whereas "L" represents that the recording of the dots has not been made. For example, FIG. 3(B) shows the manner in which the recording of dots on the line prior to the previous line is made and the recording of dots on the previous line is not effected. Further, values (each represents the degree of an increase in temperature but is called a point number herein) obtained by normalizing respective temperatures at the time that the energization of the present line has been completed, are shown in the form of numerical values. It is understood that the history control should be effected in such a manner as to provide large energy because the point number is low as illustrated in FIG. 3(A), for example and to provide small energy because the point number is high as shown in FIG. 3(D).

FIG. 4 is a view showing the relationship between the point numbers shown in FIG. 3 and the output data (latch data) which have been latched in the latch circuit 21. As has been already described above, the latch data show whether the dots on the line prior to the previous line, the previous line and the present line are recorded. Now, the number of levels is defined depending on the number of "H". The more the number of "H" produced in a pattern increases, the more the number of levels becomes high. The suitable energized states corresponding to four kinds of patterns shown in FIG. 4 are represented as examples by FIGS. 5(G) through 5(J).

In order to set the suitable amount of current corresponding to the point numbers, the gate signal generator 31 generates the gate signals GA, GB, GC shown in FIGS. 5(D), 5(E) and 5(F). As a result, the outputs of the AND gate 51, which correspond to patterns outputted from the latch circuit 21, are represented as shown in FIGS. 5(G) through 5(J) and hence the amount of current corresponding to the point numbers is set. That is, the pattern (L, L, H) indicative of the low point number is controlled in such a manner that the amount of current increases. On the other hand, the patterns representative of the large point numbers are so controlled that the amount of current decreases. Incidentally, the gate signals GB, GC are identical in pulse width to each other. In the case of patterns which fall under the same level, energization time intervals are identical in total to each other.

Incidentally, as a technique related to the conventional thermal head driving circuit, there is known a thermal head driving device which has been disclosed in Japanese Patent Application Laid-Open Publication No. 64-1560, for example.

The conventional thermal head driving circuit has been constructed as described above. Therefore, when the number of the outputs of the latch circuit 21 is increased to strictly effect the history control, the number of patterns serving as objects to be controlled increases, thereby causing a difficulty in suitably controlling the patterns.

FIG. 6 is a circuit diagram showing a conventional thermal head driving circuit for controlling the energization of each heating or thermal resistor in accordance with a decision made as to whether or not thermal resistors corresponding to adjacent dots generate heat. The same elements of structure as those shown in FIG. 1 are identified by like reference numerals and the description of common elements will therefore be omitted.

In the same drawing, designated at numeral 52 is a logical product (AND) provided in plural form, for outputting a pulse signal indicative of the state of energization. Designated at numeral 82 is an AND gate provided in plural form, which has two input terminals electrically connected to the Q1 terminals of the latch circuits 21 provided adjacent to each other. Reference numeral 92 is an analog switch provided in plural form, which is enabled in response to a signal outputted from the corresponding AND gate 82.

Designated at numeral 102 is a control signal which is input to each analog switch 92 as a predetermined pulse signal.

The operation of the thermal head driving circuit will now be described below. Each latch circuit 21 successively takes in data from a shift register 1 in accordance with a latch signal input from the outside in the same manner as described in the conventional example. As a result, recorded information on the previous line is outputted to the Q2 terminal, whereas recorded information on a line prior to the previous line is outputted to the Q3 terminal. Further, recorded information on the present line appears at the Q1 terminal of each latch circuit 21. However, recorded information, which correspond to adjacent dots, i.e., appear at the Q1 terminals of the respective adjacent latch circuits, are input to their corresponding AND gates 82.

When, on the other hand, the control signal 102 is input to each analog switch 92 in the input timing of the latch signal as shown in FIG. 7 and each analog switch 92 is turned on in response to the output of each AND gate 82, the control signal is input to each gate circuit 52. In this case, as illustrated in FIG. 7, a time interval required to bring the control signal 102 to a conducting state is set so as to be shorter more or less than a time interval required to bring the gate signal GA of the gate signal generator 31 to a conducting state.

When the inputs of any one of the AND gates 82, i.e., the signals of the Q1 terminals of the latch circuits 21 arranged in pairs adjacent to each other are both "H" in level, the analog switch 92 electrically connected to the AND gate 82 is closed so as to supply the control signal 102 to the corresponding gate circuit 51. When, on the other hand, either one of the respective Q1 terminals of the adjacent latch circuits 21 or both Q1 terminals are "L" in level, the corresponding analog switch 92 is turned off, so that the control signal 102 is not supplied to the corresponding gate circuit 51*a*. Accordingly, each of the gate inputs of the gate circuit 52 is brought to a high impedance.

FIG. 8 shows temperatures on surfaces of adjacent thermal resistors at the time that they have produced heat. Let's now assume that adjacent thermal resistors are respectively represented as *7a*, *7b*, *7c* as shown in FIG. 8(A). When the respective thermal resistors *7a*, *7b*, *7c* are selectively activated under a given condition, heat is generated by the thermal resistor *7b* but not produced by the thermal resistors *7a*, *7c* disposed adjacent to the thermal resistor *7b*, for example. In this case, the temperature of the generated heat is 250° C. as shown in FIG. 8(B). When, on the other hand, the heat is produced by the adjacent thermal resistors *7a*, *7c*, the temperature of the generated heat becomes 280° C. as shown in FIG. 8(D).

Further, when the heat is generated by either one of the thermal resistors *7a* and *7c*, the temperature of the generated heat is brought to 265° C. as shown in FIG. 8(C). Accordingly, the relative influence of the heat generated by the adjacent thermal resistors on the adjacent thermal resistors can be corrected so as to enable accurate printing by supplying the energy determined by the time required to make the control signal active to each of the thermal resistors *7a*, *7b*, *7c*, thereby making it possible to obtain a well-balanced density for printing under the high-level heat history control.

The conventional thermal head driving circuit is constructed as described above. Therefore, when it is desired to strictly effect the history control, the adjacent data of the Q1 output terminals of the respective latch circuits 21 appear only at one of both ends of the formed circuit. Thus, when the formed circuit is arranged in plural form, each of thermal resistors located at boundaries between the respective adjacent formed circuits for each formed circuit is subjected to heat control different from that effected on other portions, thereby causing a problem that the density control for printing cannot be strictly achieved.

SUMMARY OF THE INVENTION

With the foregoing problems in view, it is a first object of the present invention to provide a thermal head driving circuit wherein history control can be suitably effected by a less number of gate signals even when the number of patterns corresponding to objects to be controlled is increased after an increase in the number of outputs of each latch circuit has been made.

In order to achieve the above object, the thermal head driving circuit is provided with a gate signal generator for supplying, to gate circuits, gate signals corresponding to signals which indicate the states of energization corresponding to respective output patterns of each latch circuit and which can realize the states of energization corresponding to output patterns which fall under a high level by an increased number of pulse signals when patterns, that the degrees of increases in temperatures are the same, of output patterns which fall under different levels, are used.

It is a second object of the present invention to provide a thermal head driving circuit capable of overcoming inconvenience on the control of printing density, which is developed by thermal resistors at the boundaries between respective formed circuits for every formed circuits, and supplying the most suitable printing energy to each recording head.

In order to achieve the second object, the thermal head driving circuit selects or takes in the outputs of each latch circuit as external input/output connection signals only at boundaries (two points) between respective formed circuits, and connects the outputs of latch circuits located at the boundaries between respective mutually-arranged formed circuits to one another, thereby taking in or producing the outputs as adjacent recorded information.

The above and other objects, features and advantages of the present invention will become apparent from the following description and the appended claims, taken in conjunction with the accompanying drawings in which preferred embodiments of the present invention are shown by way of illustrative example.

BRIEF DESCRIPTION OF THE DRAWINGS

FIG. 4 is a view for describing the relationship between latch data indicative of four kinds of patterns and point numbers;

FIG. 5 is a timing chart for describing gate signals outputted from a conventional gate signal generator and the output of each AND circuit and the like;

FIG. 10 is a view for describing the relationship between latch data indicative of eight kinds of patterns and point numbers;

FIG. 14 is a view for describing the relationship between latch data indicative of sixteen kinds of patterns and point numbers;

DETAILED DESCRIPTION OF THE PREFERRED EMBODIMENTS

Preferred embodiments of the present invention will hereinafter be described with reference to the accompanying drawings.

Figure 9:
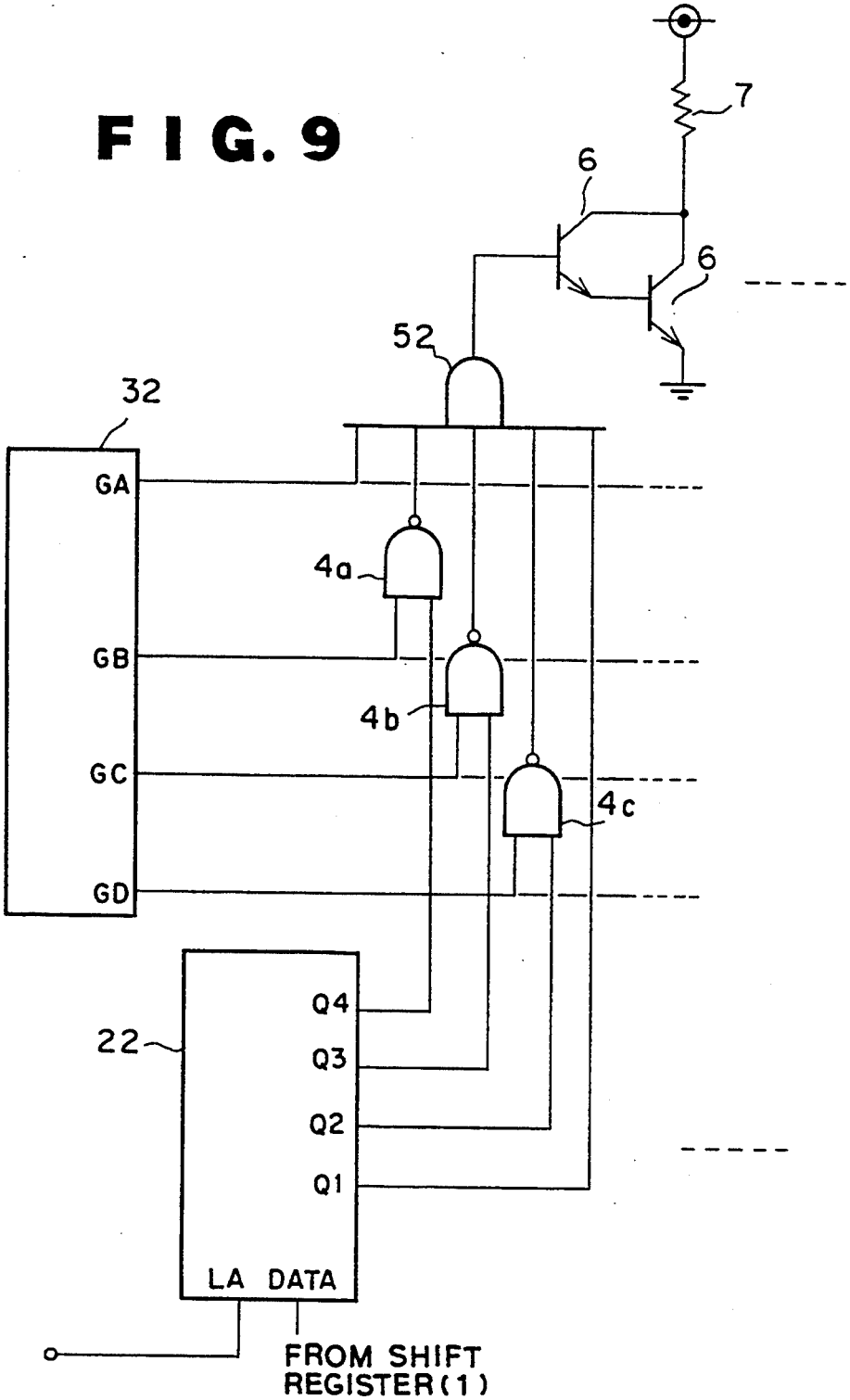
FIG. 9 is a circuit diagram illustrating a thermal head driving circuit according to one embodiment of the present invention.

FIG. 9 is a block diagram showing the structure of a thermal head driving circuit according to a first embodiment of the present invention.

Figure 1:
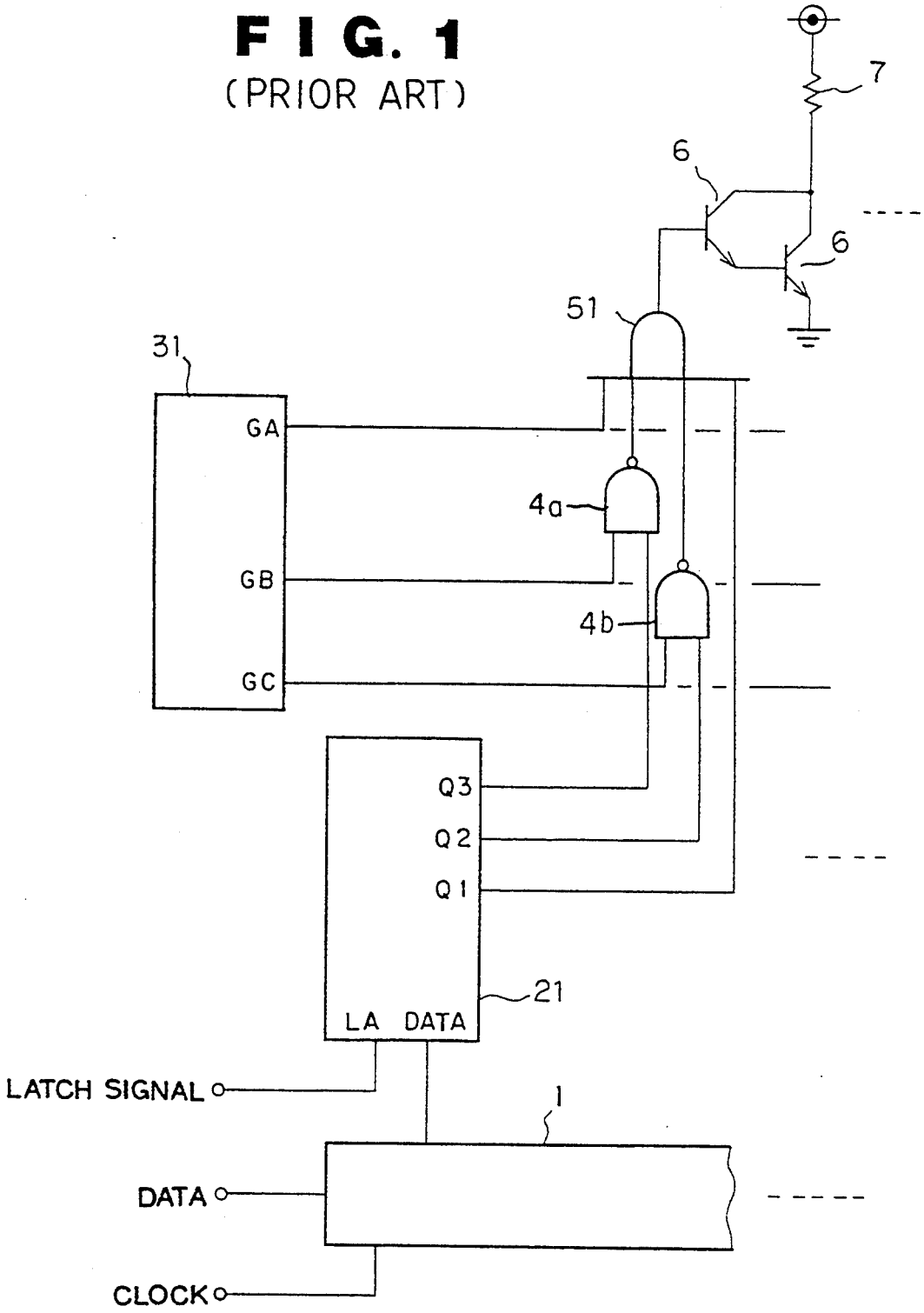
FIG. 1 (PRIOR ART)
FIG. 1 is a circuit diagram showing a conventional thermal head driving circuit.

In the same drawing, there are shown a latch circuits 22 provided in plural form, which outputs four latch data therefrom, a gate signal generator 32 for generating four gate signals therefrom, a NAND gate 4*c* provided in plural form, and an AND gate provided in plural form, which is supplied with five inputs. The same elements of structure as those shown in FIG. 1 are identified by like reference numerals. Incidentally, a gate circuit is made up of three NAND gates 4*a*, 4*b*, 4*c* and an AND gate 52.

The operation of the thermal head driving circuit constructed as described above will now be described below. Each latch circuit 22 successively takes in data from a shift register 1 in response to latch signals GA through GD in a manner similar to a conventional latch circuit. In this case, however, each latch circuit 22 is of a four-stage arrangement. Therefore, recorded information on the previous line is supplied to the Q2 terminal and recorded information on a line prior to the previous line is supplied to the Q3 terminal. Further, recorded information on a line before the above two lines appears at the Q4 terminal. Thus, the control for energizing, i.e., electrically making conductive the present line of the Q1 terminal according to dots thereof can be effected based on the recorded information formed of the dots, relative to the past three lines. Patterns, which are objects to be controlled, are divided into eight increased groups as illustrated in FIG. 10.

When the objects to be controlled are divided into four groups, a pattern (H, L, H), a pattern (L, H, H) and a pattern (H, H, H) can be controlled based on the gate signals GA, GB, the gate signals GA, GC and the gate GA, GB, GC, respectively as illustrated in FIGS. 5(D) through 5(J). That is, the control for energizing, i.e., electrically making each line conductive could be effected according to each of the patterns. In this case, such control was easy because point numbers indicative of increases in temperatures was different from each other as shown in FIG. 4.

As described above, there are produced eight patterns and the point numbers are the same. However, patterns different in level from each other are produced as shown in FIG. 10. Thus, the most suitable control cannot be done unless a method of controlling the energization is devised. Let's now consider where the energization control is effected by generating gate signals GA through GD shown in FIGS. 11(B) through 11(E), for example. In this case, energization time intervals are identical in total to each other in the case of respective patterns which fall under the same level. When, for example, a pattern (H, L, L, H) shown in FIG. 10 is taken, a point number indicative of an increase in temperature is 1 and equal to that of a pattern (L, L, L, H). It is therefore desired that the amounts of heat generated by each heating or thermal resistor 7 corresponding to the two patterns are set equal to each other. It is, however, expected that the amounts of generated heat are not equal to each other due to the difference in heat or thermal inertia between L and H at the Q4 terminal as shown in FIGS. 11(F) and 11(G). In this case, the amounts of heat generated by each thermal resistor 7 corresponding to these patterns can be set so as to approach each other by providing a difference between the respective total time intervals required to energize, i.e., make each thermal resistor corresponding to the respective patterns within the same level active and by reducing the width of the gate signal GB. When, however, the width of the gate signal GB is greatly reduced, the four-stage arrangement of the latch circuit 22 is rendered ineffective.

Figure 2A:
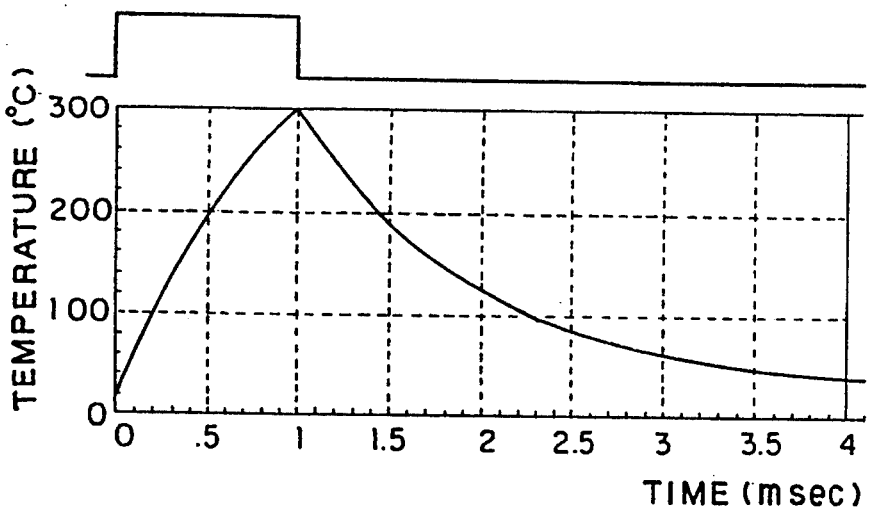
FIG. 2A (PRIOR ART)
FIG. 2 is a view for describing the relationship between a pulse applied to each thermal resistor and the temperature of heat generated thereby.
Figure 2B:
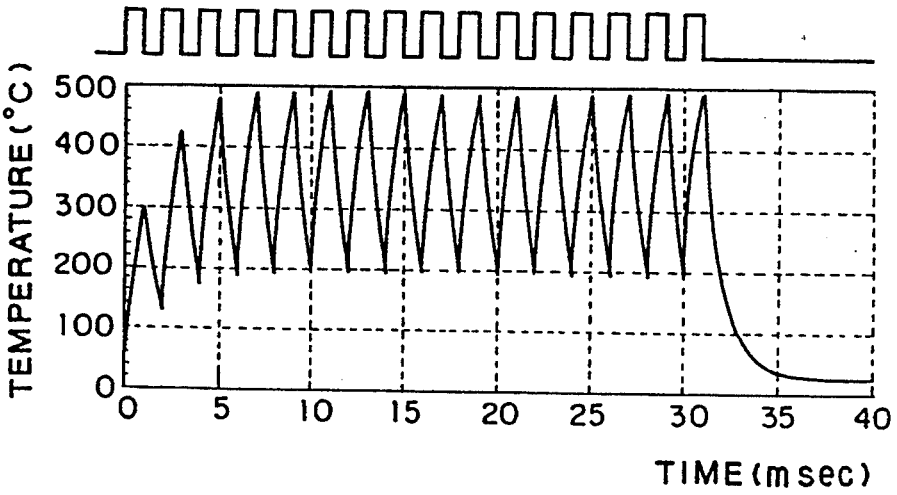
Figure 3:
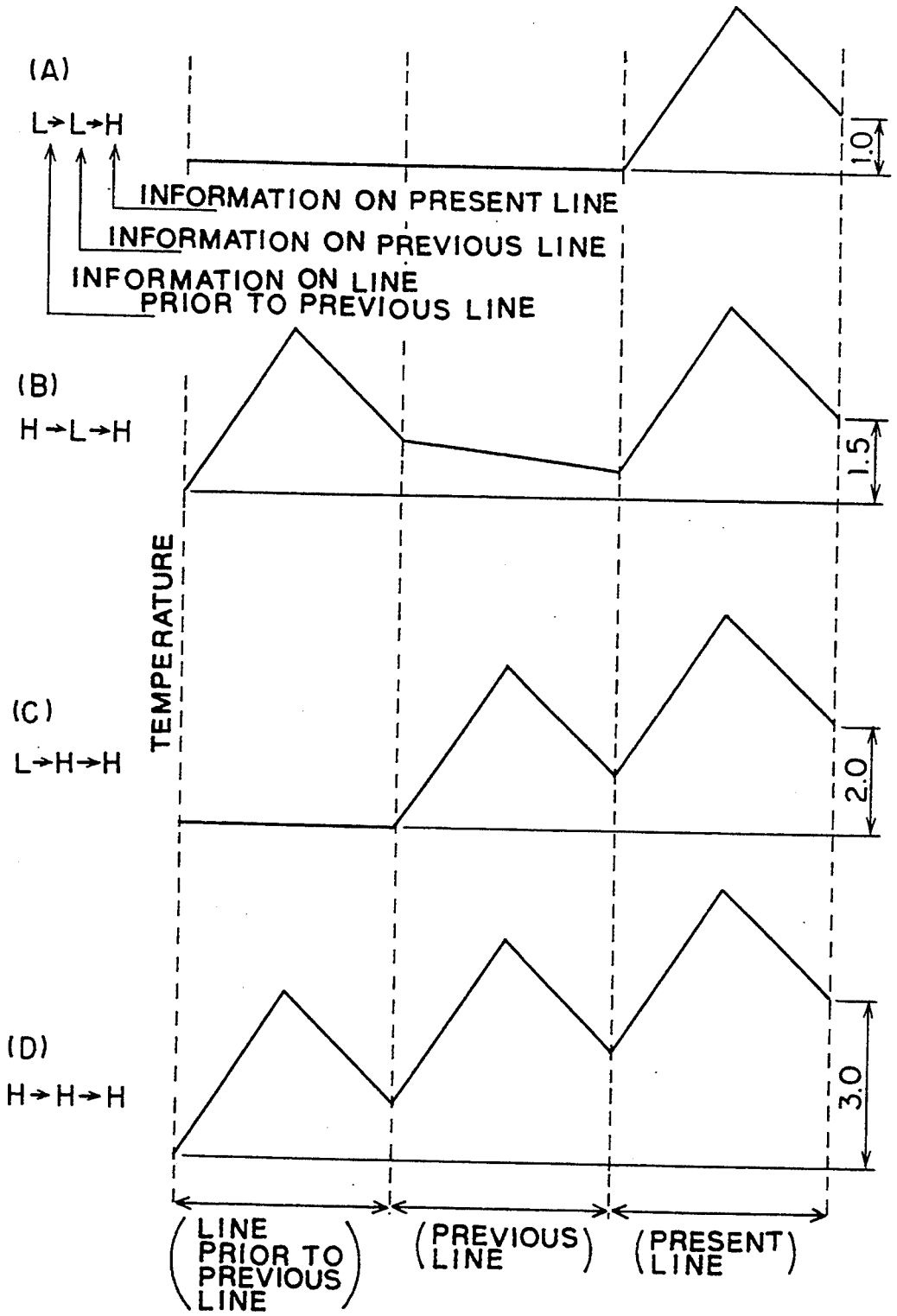
FIG. 3 (PRIOR ART)
FIG. 3 is a simplified view for describing the degrees of increases in temperatures at respective patterns.
Figure 5:
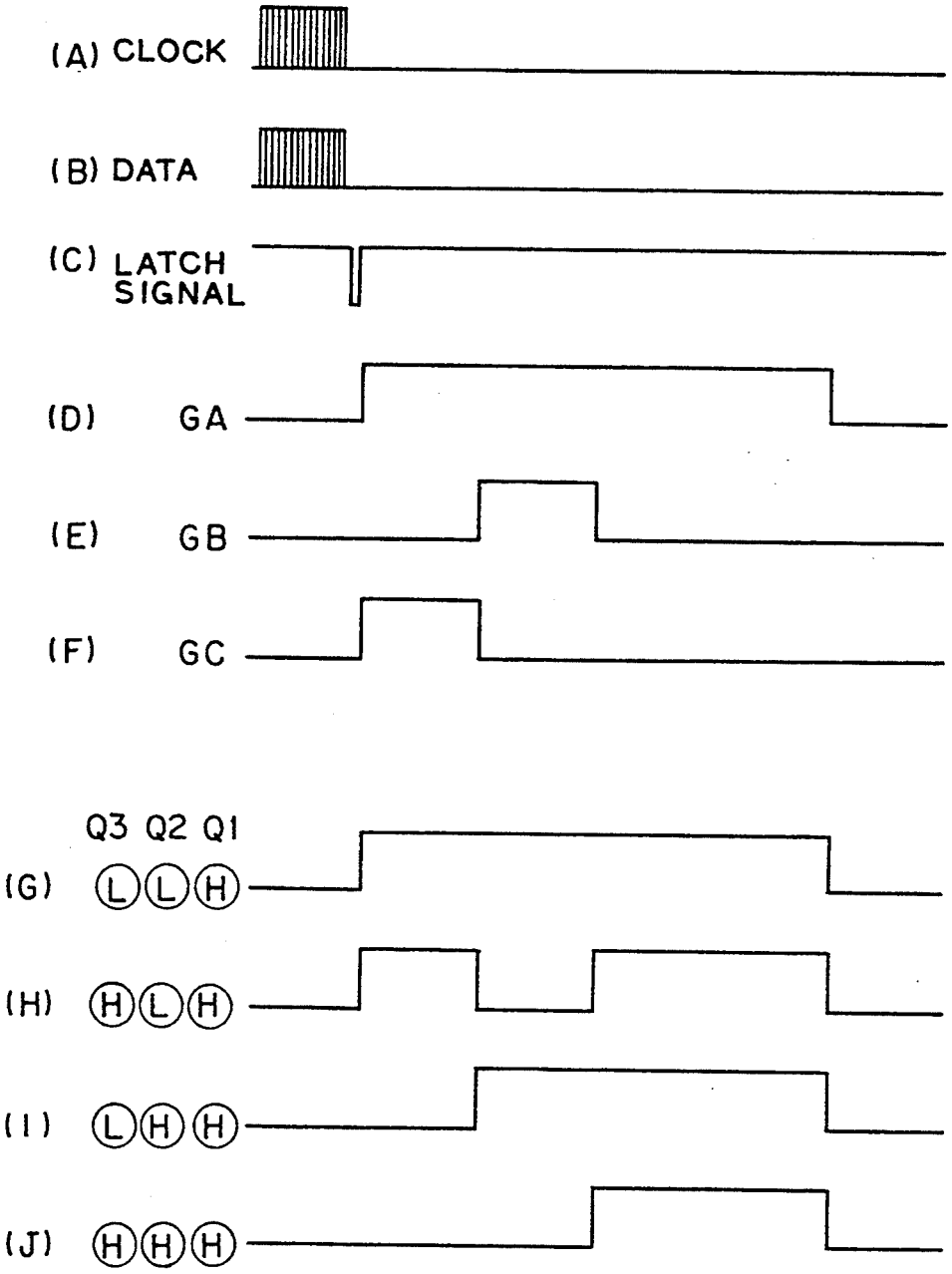
FIG. 5 (PRIOR ART)
Figure 6:
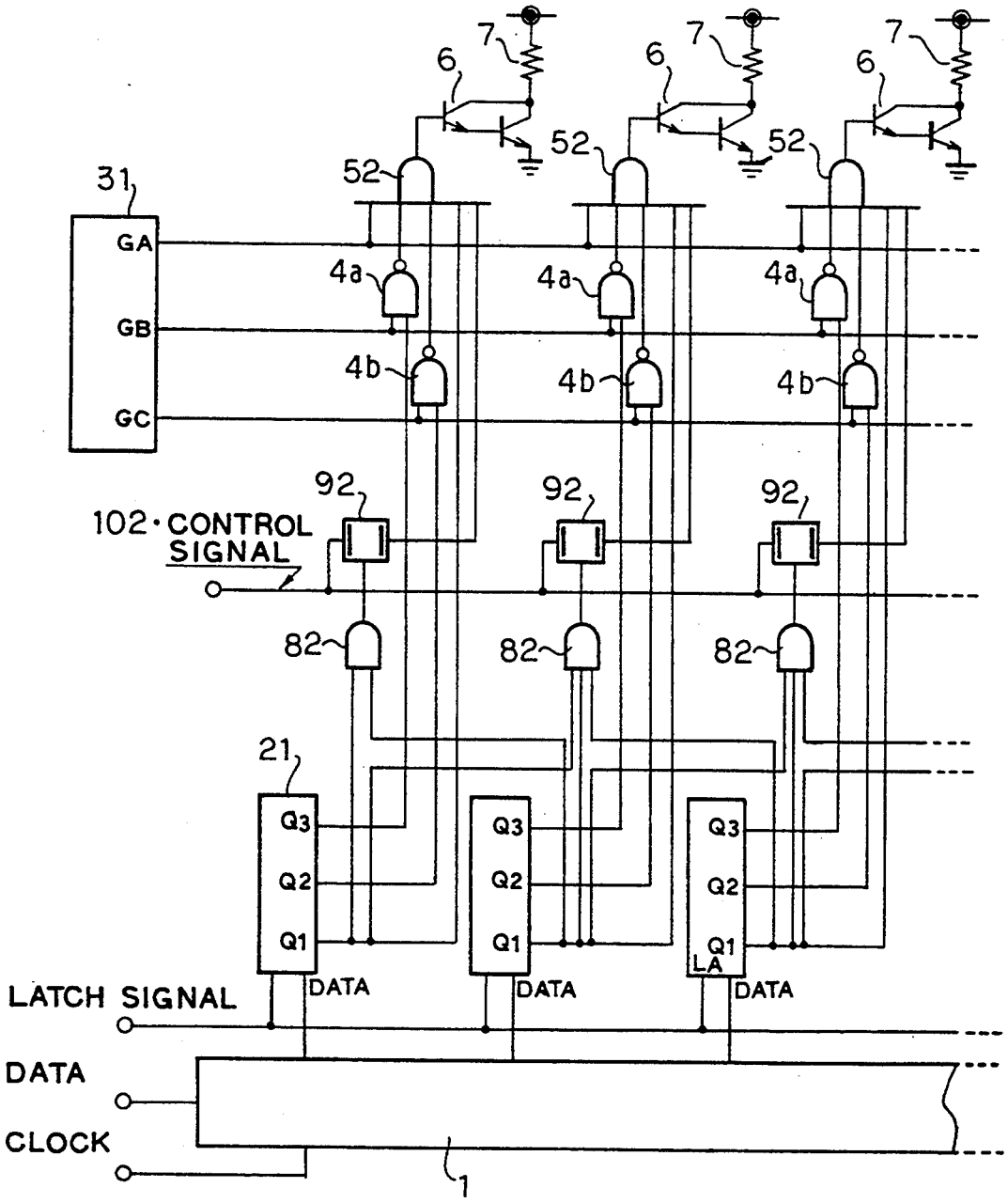
FIG. 6 (PRIOR ART)
FIG. 6 is a circuit diagram showing a conventional recording head driving circuit.
Figure 7:
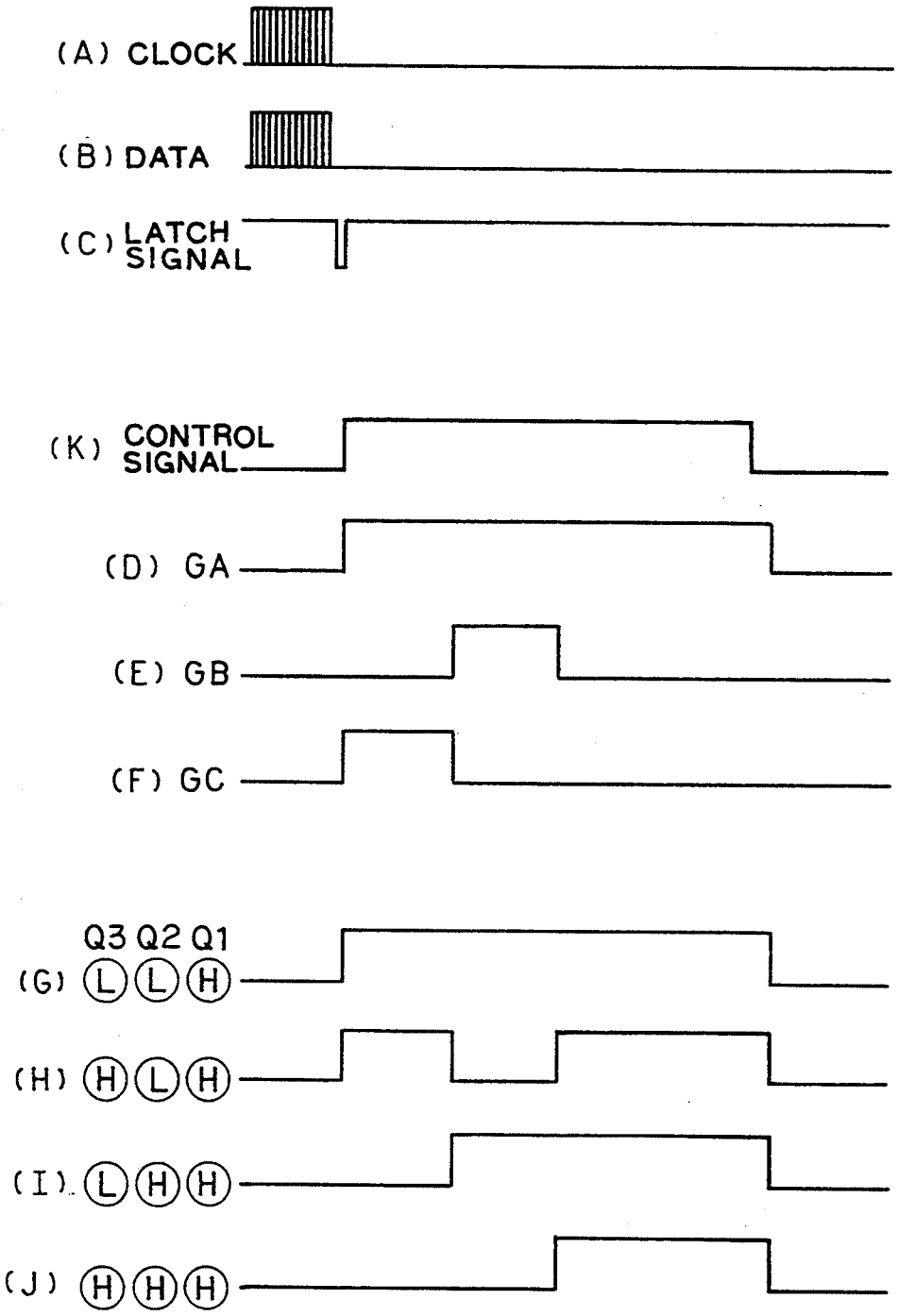
FIG. 7 (PRIOR ART)
FIG. 7 is a timing chart for describing signals which appear at respective parts of the recording head driving circuit shown in FIG. 6.
Figure 8A:
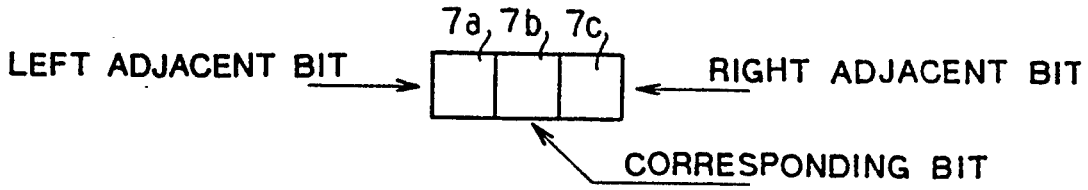
FIG. 8A (PRIOR ART)
FIG. 8 is a view for describing the influence of heat produced by a recording head on other bit adjacent to one bit.
Figure 8B:
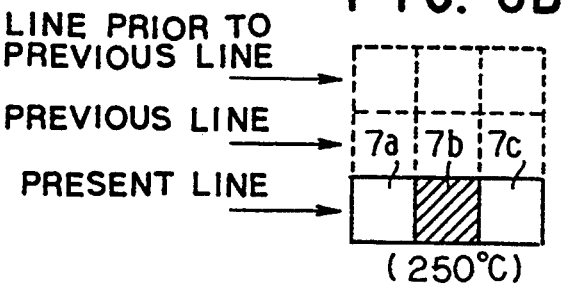
Figure 8C:
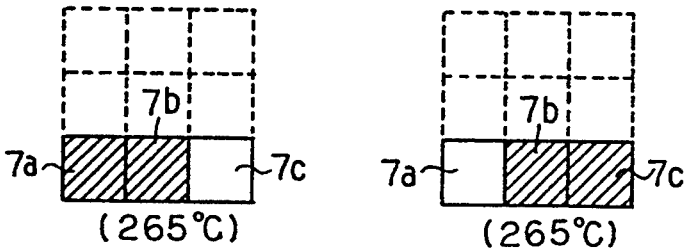
Figure 8D:
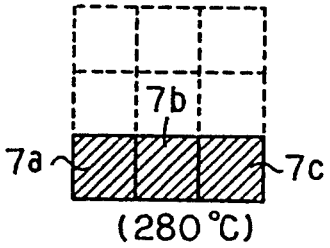

Now, a response curve of a thermal resistor 7, which is illustrated in FIG. 2(A), shows that the degree of an increase in temperature is high immediately after the start of its heat generation and its increase tends to be saturated after the temperature has increased to some extent. That is, the increase in temperature ΔT is expressed as follows:

$$\Delta T = Pd \times Rth \times \{1 - exp(-t/\tau)\}$$

where Pd is printing power, Rth is the thermal resistance of the thermal resistor 7, t is a printing time interval and $\tau$ is the time constant.

Then, the gate signal generator 32 generates gate signals GA through GD shown in FIGS. 12(B) through 12(E) using the above property. As a result, the conditions of energization of each thermal resistor 7 corresponding to the respective patterns are represented by patterns illustrated in FIGS. 12(F) through 12(M). The state of energization of the thermal resistor 7 corresponding to the pattern (H, L, L, H) shown in FIG. 12(G) is represented by a single pulse in FIG. 11(G) but represented by two pulses in FIG. 12(G). Thus, the pulses, which make it possible to raise the degree of an increase in temperature immediately after the generation of heat has been initiated, are produced twice. Therefore, the amount of heat generated by the thermal resistor 7, corresponding to the pattern (H, L, L, H) shown in FIG. 12(G) approaches substantially the same amount as the amount of the generated heat corresponding to the pattern (L, L, L, H) depicted in FIG. 12(F) even if the entire time interval required to energize such a thermal resistor 7 is short.

Even when the state of energization of each thermal resistor is set within the same level according to a difference in point number, the gate signal generator 32 generates the gate signals GA through GD in such a manner that when the point number of each pattern is small, the state of energization is represented by a plurality of pulses and when its point number is large, its state is represented by a signal pulse. For example, the point number of a pattern (L, H, L, H) of a level 2 is smaller than that of a pattern (L, L, H, H). Therefore, the state of energization of the thermal resistor, which is associated with the pattern (L, H, L, H), is represented by a plurality of pulses, whereas the state of energization of the thermal resistor, which corresponds to the pattern (L, L, H, H), is represented by a single pulse (see FIGS. 12(H) and 12(I)). Similarly, a pattern (H, L, H, H) of a level 3 is reduced in point number as compared with a pattern (L, H, H, H). Therefore, the state of energization of the thermal resistor, corresponding to the pattern (H, L, H, H) is represented by a plurality of pulses, whereas the state of energization of the thermal resistor, which is associated with the pattern (L, H, H, H), is represented by a single pulse (see FIGS. 12(K) and 12(L)).

Embodiment 2

Figure 13:
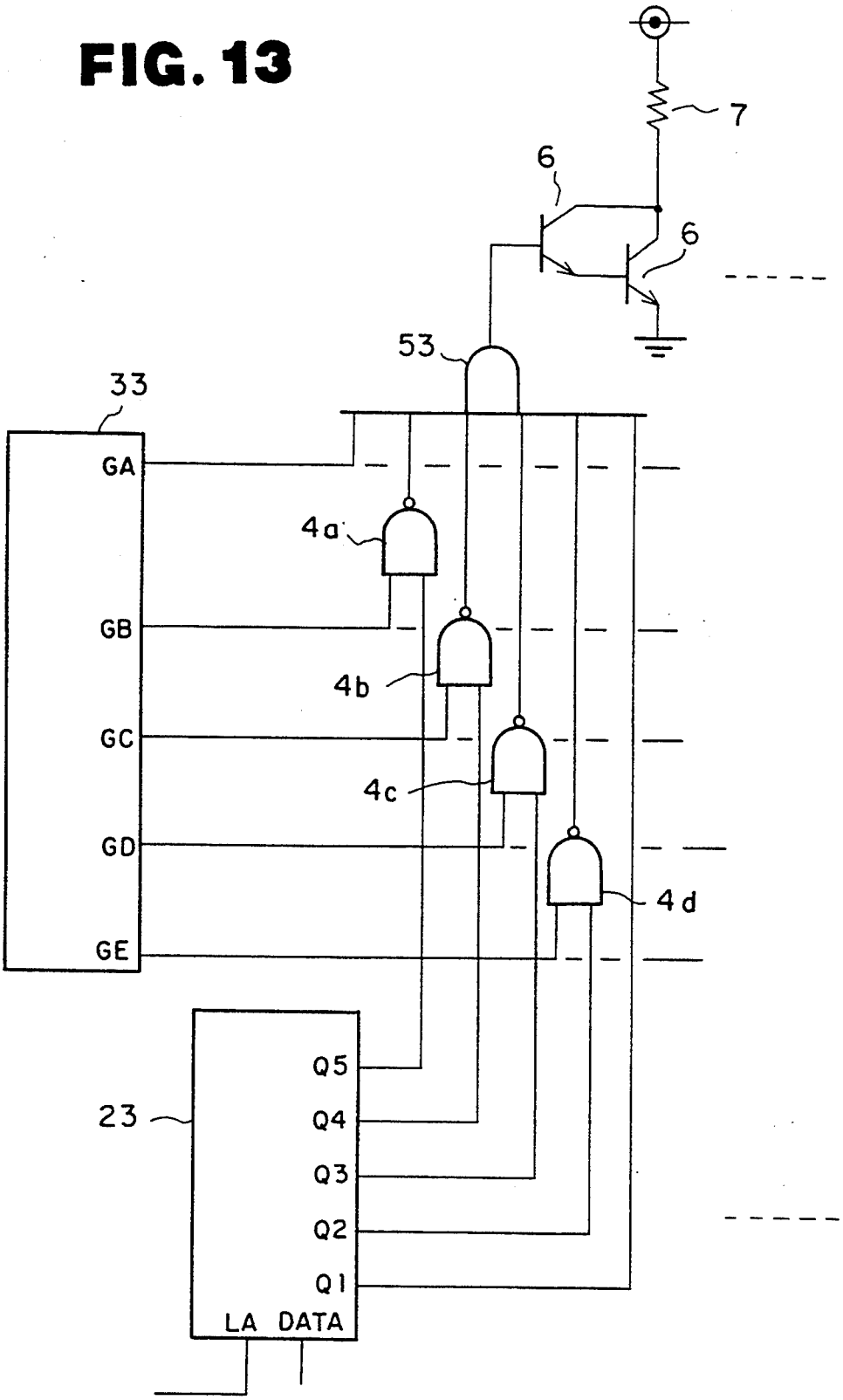
FIG. 13 is a circuit diagram depicting a thermal head driving circuit according to another embodiment of the present invention.

FIG. 13 is a circuit diagram showing a thermal head driving circuit according to a second embodiment of the present invention, in which a latch circuit 23 is of a five-stage arrangement. In this case, patterns, which are objects to be controlled, are divided into sixteen groups as illustrated in FIG. 14. Further, point numbers indicative of increases in temperatures, which are associated with the respective patterns, are represented as illustrated in FIG. 14. In this case, a pattern (L, L, L, L, H), which falls under a level 1, is identical in point number to a pattern (H, L, L, L, H) which falls under a level 2, whereas a pattern (L, L, L, H, H), which falls under the level 2, is identical in point number to a pattern (H, H, L, L, H) which belongs to a level 3. However, the respective total energization time intervals differ from each other because the levels are different from one another.

Figure 15:
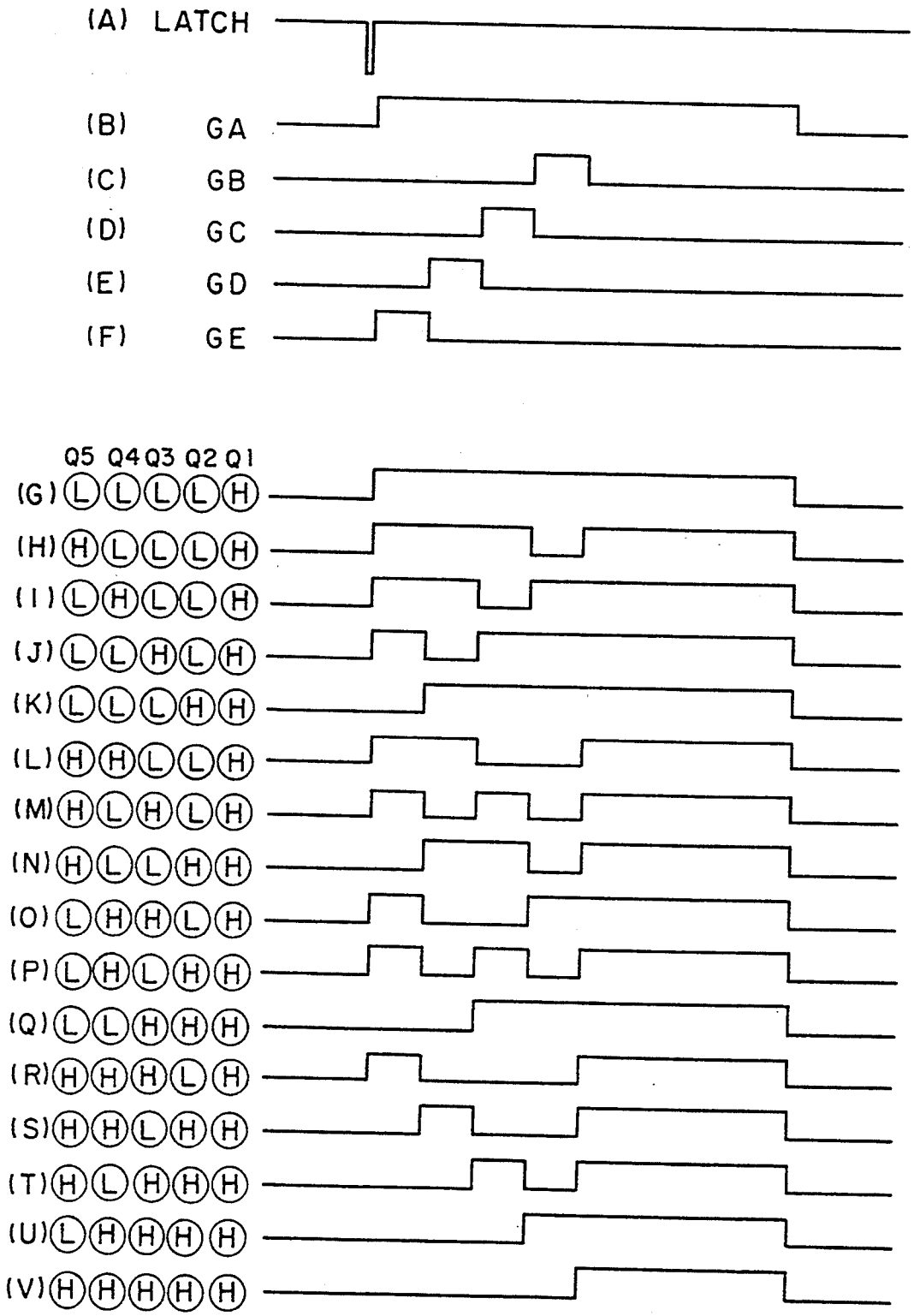
FIG. 15 is a timing chart for describing gate signals outputted from a gate signal generator employed in the thermal head driving circuit shown in FIG. 13 and outputs of each AND gate.

Thus, the state of energization of a thermal resistor, which is associated with each of the patterns (L, L, L, L, H) and (L, L, L, H, H), is represented by a single pulse and the amount of heat generated by the thermal resistor is reduced. That is, a gate signal generator 33 generates gate signals shown in FIGS. 15(B) through 15(F). As a result, the states of energization of each thermal resistor, which correspond to respective patterns, are represented as illustrated in FIGS. 15(G) through 15(V). Now, the state of energization of the thermal resistor corresponding to a pattern (L, L, L, L, H), which falls under a level 1, is represented by a single pulse, whereas the state of energization of the thermal resistor, which is associated with a pattern (H, L, L, L, H) of a level 2, is represented by a plurality of pulses (see FIGS. 15(G) and 15(H)). In this case, the amounts of heat generated by the thermal resistors 7, which correspond to the two cases, approach each other. Similarly, the state of energization of the thermal resistor, which is associated with a pattern (L, L, L, H, H) of the level 2, is represented by a single pulse, whereas the state of energization of the thermal resistor, which corresponds to a pattern (H, H, L, L, H) of a level 3, is represented by a plurality of pulses (see FIGS. 15(K) and 15(L)). In this case, the amounts of heat generated by the thermal resistors, which are associated with the two, are brought so as to approach each other.

Even when the state of energization of each thermal resistor is set within the same level according to a difference in point number, the gate signal generator 33 generates the gate signals in such a manner that when the point number of each pattern is small, the state of energization of each thermal resistor is represented by a plurality of pulses and when its point number is large, its state is represented by a signal pulse. The state of energization of the thermal resistor, which is associated with the pattern (L, L, H, L, H), for example, is represented by a plurality of pulses, whereas the state of energization of the thermal resistor, which corresponds to the pattern (L, L, L, H, H), is represented by a single pulse (see FIGS. 15(J) and 15(K)). Similarly, the states of energization of each thermal resistor which correspond to the patterns (L, H, H, L, H) and (L, H, L, H, H) of the level 3, are respectively represented by a plurality of pulses, whereas the state of energization of the thermal resistor, which is associated with the pattern (L, L, H, H, H), is represented by a single pulse (see FIGS. 15(O) through 15(Q)). Further, the states of energization of each thermal resistor, which are associated with patterns (H, H, H, L, H), (H, H, L, H, H) and (H, L, H, H, H) of a level 4, are respectively represented by a plurality of pulses, whereas a pattern (L, H, H, H, H) which falls under the level 4, is represented by a single pulse (see FIGS. 15(R) through 15(U)).

Embodiment 3

Figure 16:
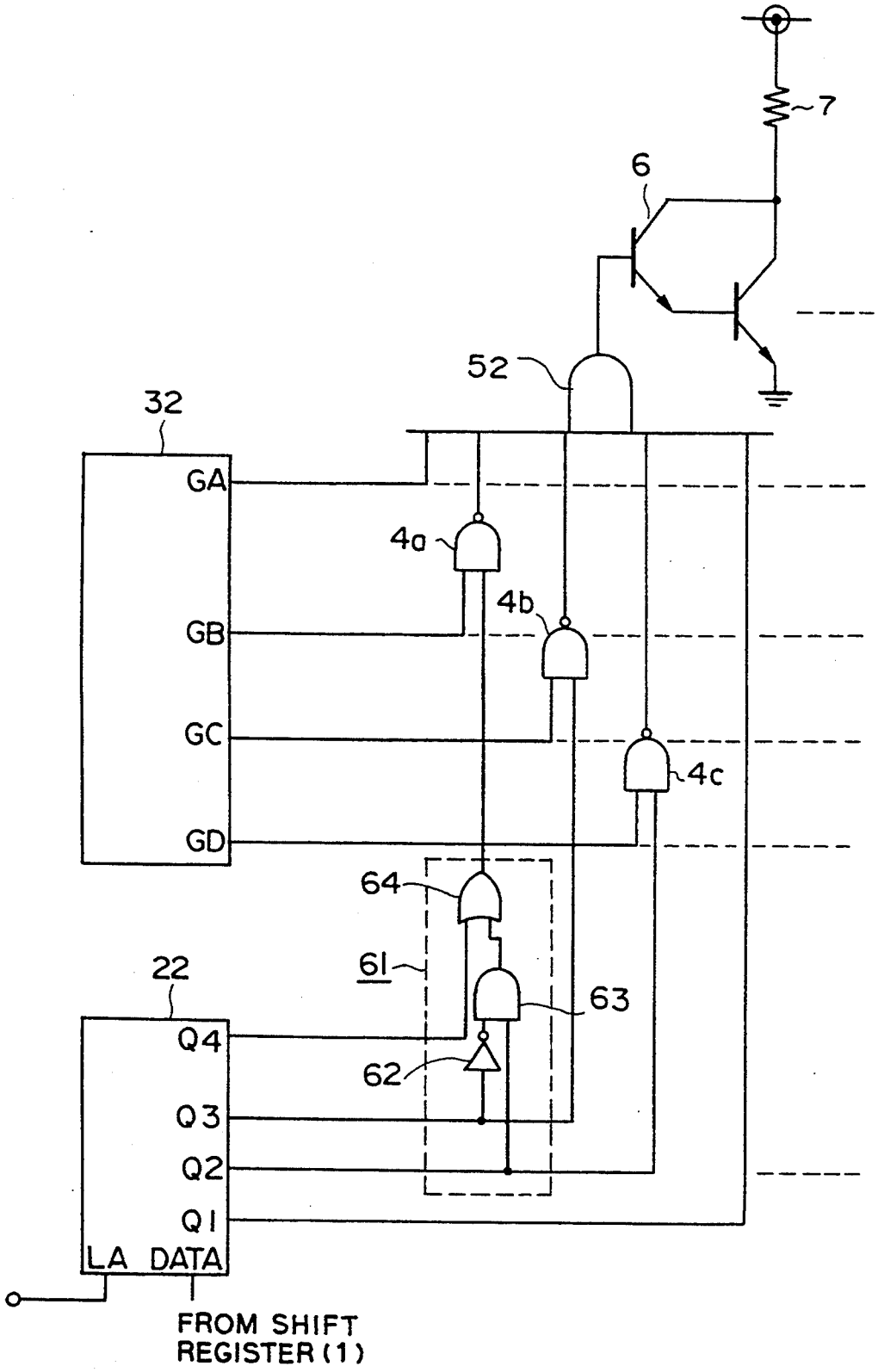
FIG. 16 is a circuit diagram showing a thermal head driving circuit according to a further embodiment of the present invention.

FIG. 16 is a circuit diagram showing a thermal head driving circuit according to a third embodiment of the present invention. The same elements of structure as those employed in FIG. 9 are identified by like reference numerals and their description will therefore be omitted.

Referring to FIG. 16, reference numeral 61 indicates a collating circuit provided in plural form, for detecting predetermined patterns which appear at the Q2, Q3, Q4 terminals of a latch circuit 22 and supplying the detected outputs to a NAND gate 4*a*.

Each collating circuit 61 comprises an AND gate 63 provided in plural form, supplied with the output of the Q2 terminal and an output obtained by inverting the output of the Q3 terminal with an inverter 62, and an OR gate 64 provided in plural form, supplied with the output of the AND gate 63 and the output of the Q4 terminal.

Figure 17:
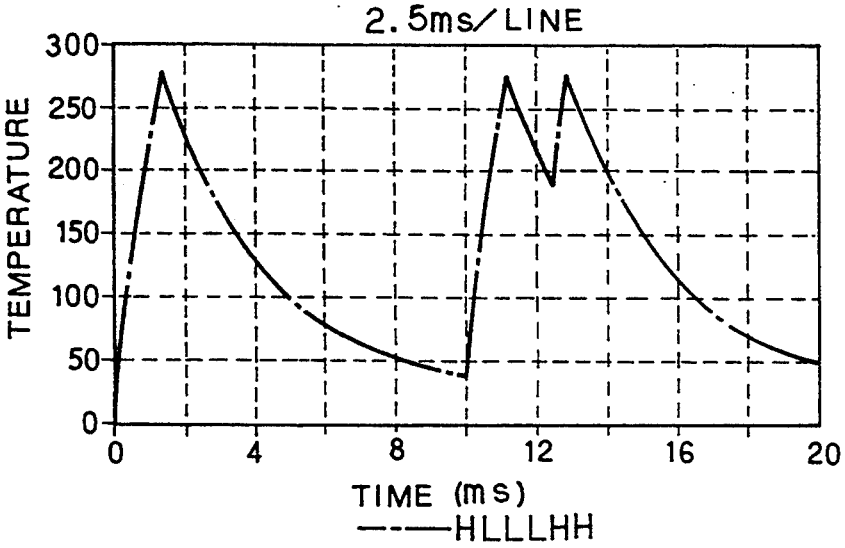
FIG. 17 is a view for describing the relationship between a given output pattern and an increase in temperature of each thermal resistor.

The operation of the thermal head driving circuit according to the third embodiment will now be described. Even in the present embodiment, eight patterns are produced as objects to be controlled in a manner similar to the first embodiment shown in FIG. 9. Further, the patterns, which are different in level from each other, are produced as shown in FIG. 10 although their point numbers are identical to each other. In order to solve this problem, there is proposed a method of controlling the thermal head driving circuit by making use of the number of pulses for energization, i.e., controlling the number of the pulses for the energization within a predetermined time interval. However, the control based on this method is basically effected at a preset relatively high temperature. Therefore, the relationship between a characteristic at the time of the rising and falling of a heat response characteristic and a recording cycle or period is of importance. FIG. 17 shows a polarity curve indicative of a heat response characteristic produced when the printing is made at a recording period of 2.5 ms/line. At this time, a continuous pattern, which is represented in the form of (H, L, L, L, H, H), is used. What is problem now, is as follows. That is, even if any pattern is used for printing, the printing is effected at a temperature of 275° C. or so when the present line is "H" in level. When, however, the pattern is continuously represented in the form of "H, H", the heat or thermal inertia of the previous line remains stored and a great decrease in heat does not take place even when a printing period for the corresponding line comes out. This is because a previous line energization time interval required to print data on the previous line requires a time interval capable of providing substantially full-power energization due to the fact that a line prior to the previous line and a line before the four lines as seen from the present line are both "L" in level, and hence much rising time is required.

When the line prior to the previous line is "H" in level, for example, the time required to start up the previous line or make the same active can be reduced, thereby making it possible to provide much time required to start down or make the previous line inactive. Since the corresponding line is taken as being "H" in level, the above problem can be solved by using the heat inertia. That is, it is determined that an increase in the heat inertia takes place only when the corresponding pattern, e.g., (L, L, H, H) is selected. Further, the time required to energize the corresponding line is forcibly set so as to be shorter than the normal line energization time. In the present embodiment, the collating circuit 61 is provided as a means for effecting such a process.

Figure 18:
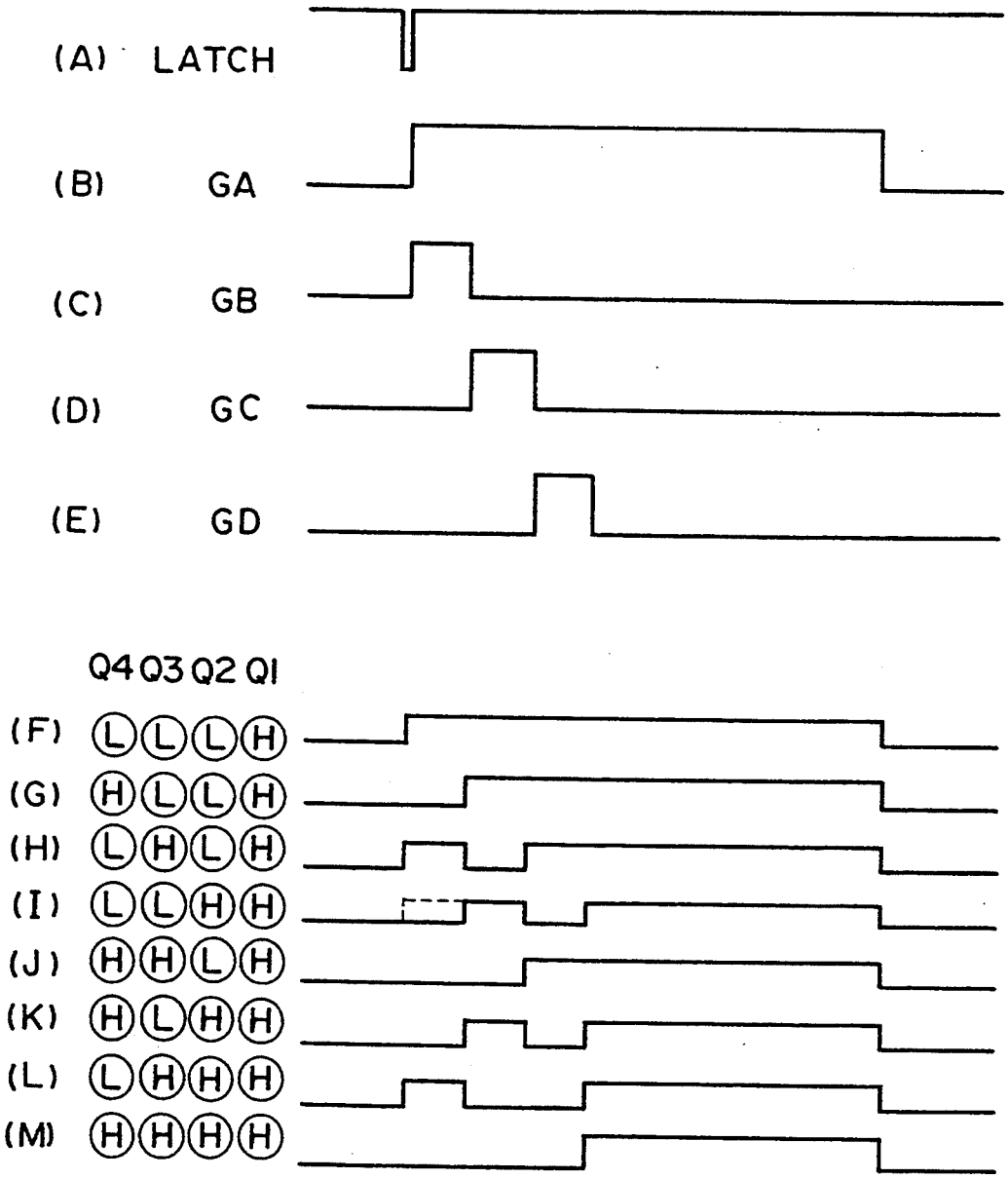
FIG. 18 is a timing chart for describing gate signals outputted from a gate signal generator employed in thermal head driving circuit shown in FIG. 16 and outputs of each AND gate.
Figures 19A, 19B:
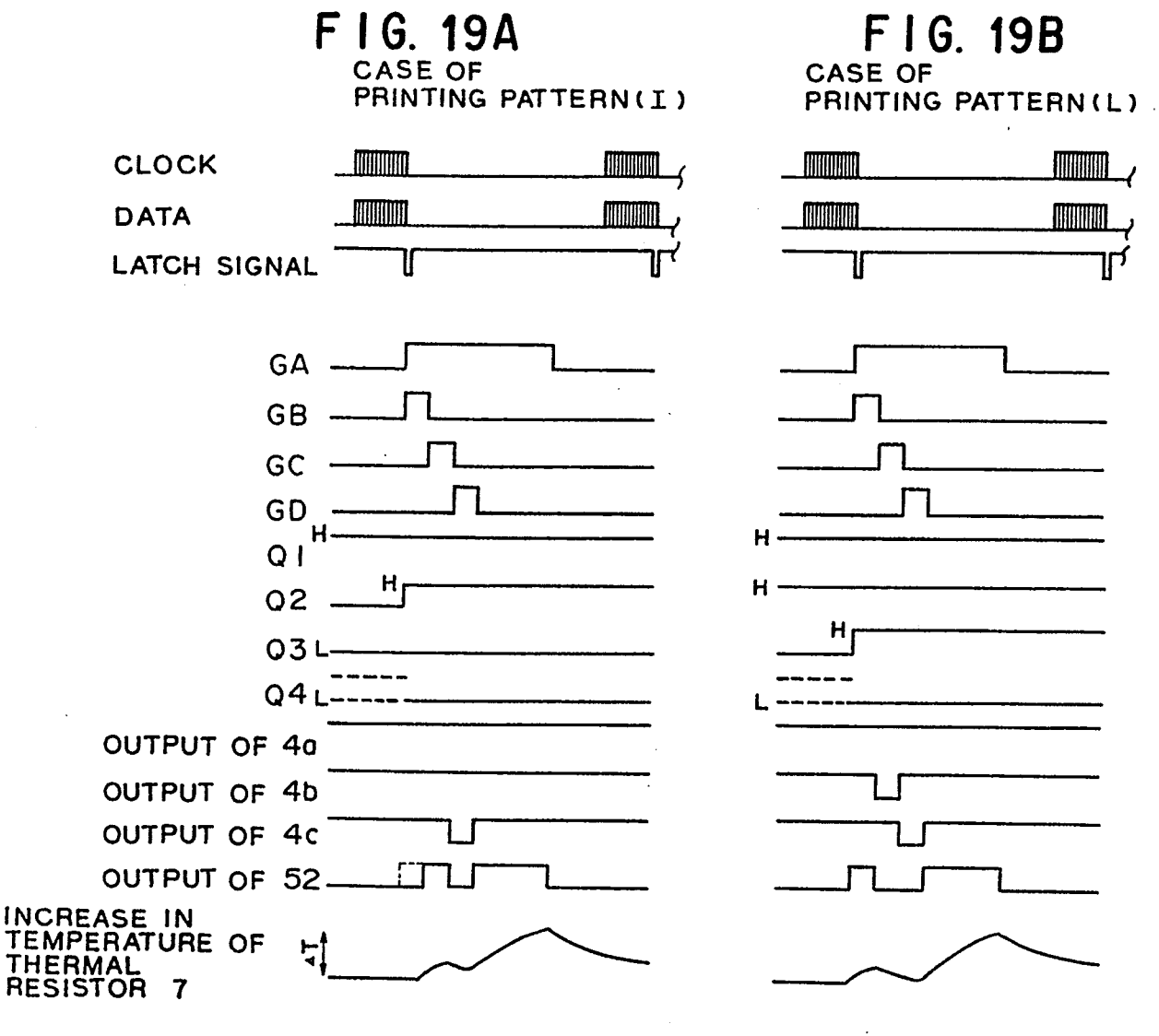
FIGS. 19A and 19B are timing charts for describing gate signals, outputs of NAND gates, outputs of AND gates, an increase in temperature of each thermal resistor, etc.

FIG. 18 shows the relationship between gate signals GA through GD and eight patterns. FIGS. 19A and 19B for describing the gate signals GA through GD, the respective outputs of NAND gates 4*a* through 4*b*, the output of each AND gate 52, an increase in temperature of each thermal resistor 7, etc. at the time that the patterns (I) and (L) shown in FIG. 18 are used as examples.

Figure 11:
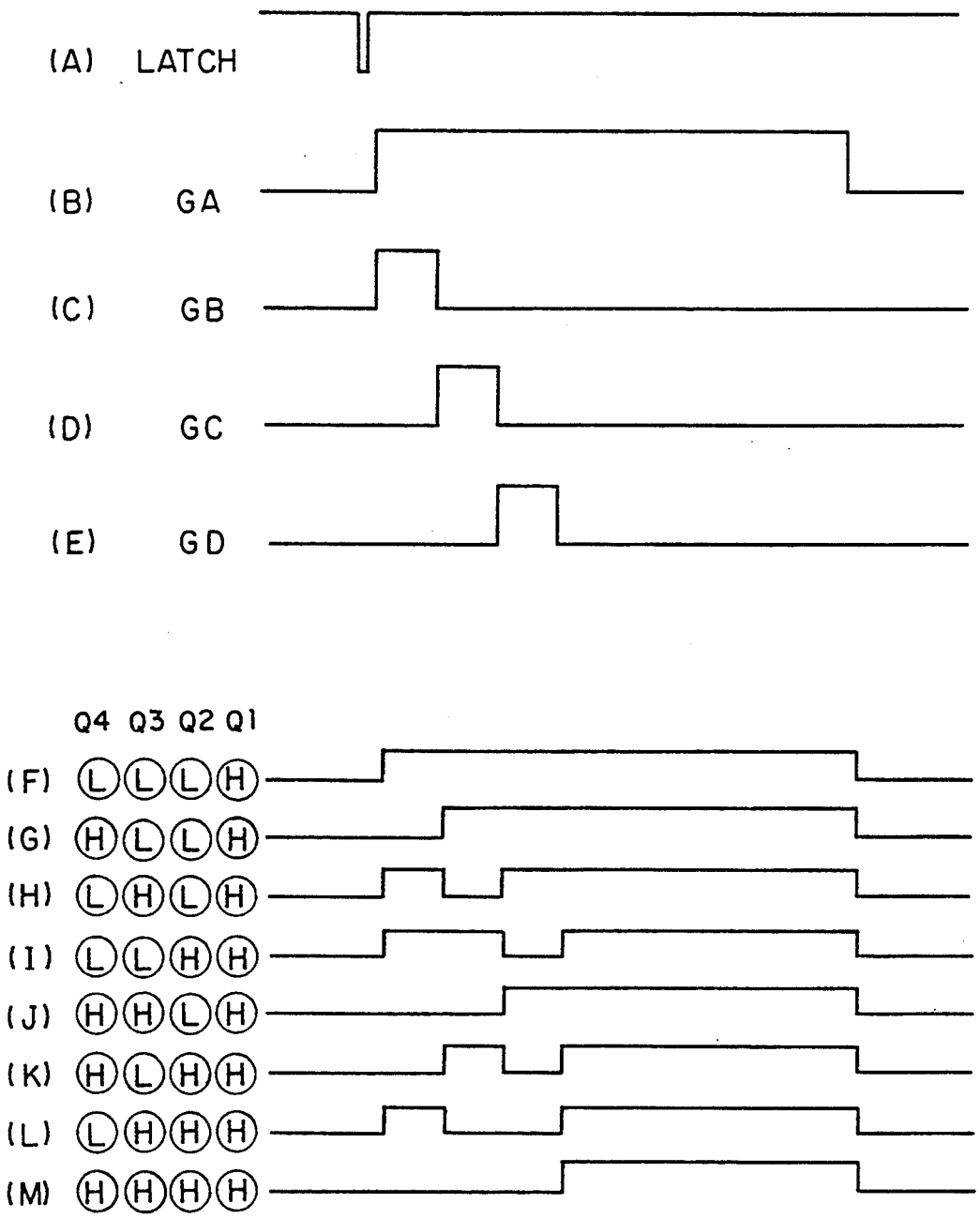
FIG. 11 is a timing chart for describing gate signals and outputs of each AND gate as an illustrative example.
Figure 12:
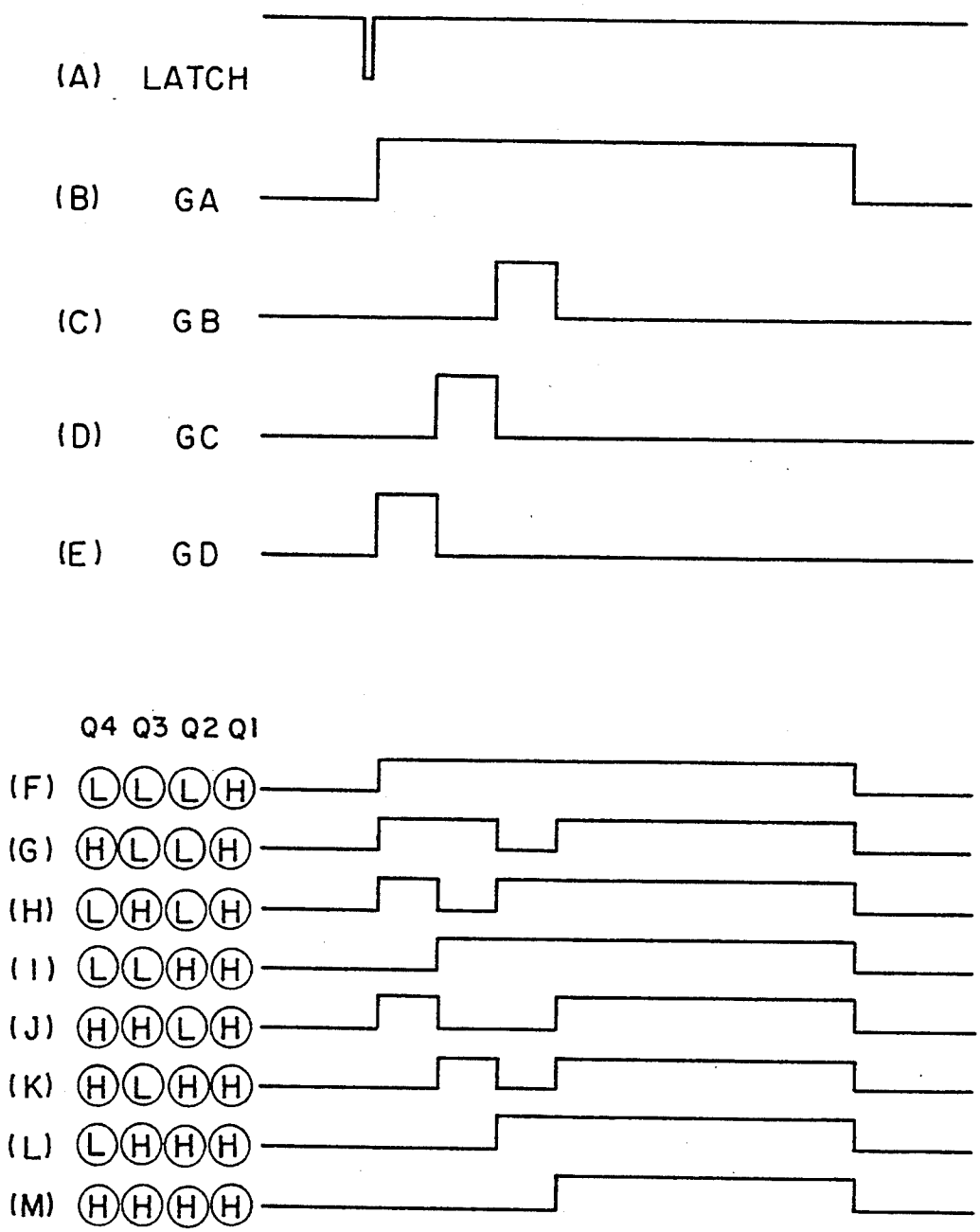
FIG. 12 is a timing chart for describing gate signals outputted from a gate signal generator employed in the thermal head driving circuit shown in FIG. 9 and other outputs of each AND gate as another illustrative example.

The gate signals GA through GD shown in FIG. 18 are identical to those shown in FIG. 11. In the case of the previous lines each indicative of an "H" level at the time that the corresponding line for printing is "H" in level (i.e., at the time that the Q1 terminal is "H" in level), there are produced the patterns (K), (L), (M) in addition to the pattern (I). Since, however, each of the patterns (K), (L), (M) has an "H" level at the line prior to the previous line or at the line before four lines as seen from the present line, a previous line energization time interval required to print data on the previous line is short. On the other hand, the pattern (I) has "L" levels at the line prior to the previous line, and the line before the four lines as seen from the present line. Therefore, the previous line energization time interval required to print the data on the previous line is long. It is thus judged that the thermal inertia with respect to the printing of the data on the corresponding line remains high. Further, the energization effected during a period in which the gate signal GB is supplied, is inhibited by the collating circuit 61. That is, the initial period of the pattern shown in FIG. 11(I) is deleted as indicated by the broken line in FIG. 18(I).

When the collating circuit 61 is not provided, the output of each AND gate 52 at the time of the pattern (I) shown in FIG. 19 is rendered "H" in level during a time interval indicated by the broken line, thereby increasing a corresponding portion of a temperature increase curve of each thermal resistor 7.

In the collating circuit 61, the output of the Q2 terminal is directly supplied to each AND gate 63 and the output of the Q3 terminal is inverted by the inverter 62 so as to be supplied to each AND gate 63. Accordingly, the collating circuit 61 effects the above deletion process when the previous line is represented by "H" and the line prior to the previous line is represented by "L".

Embodiment 4

Figure 20:
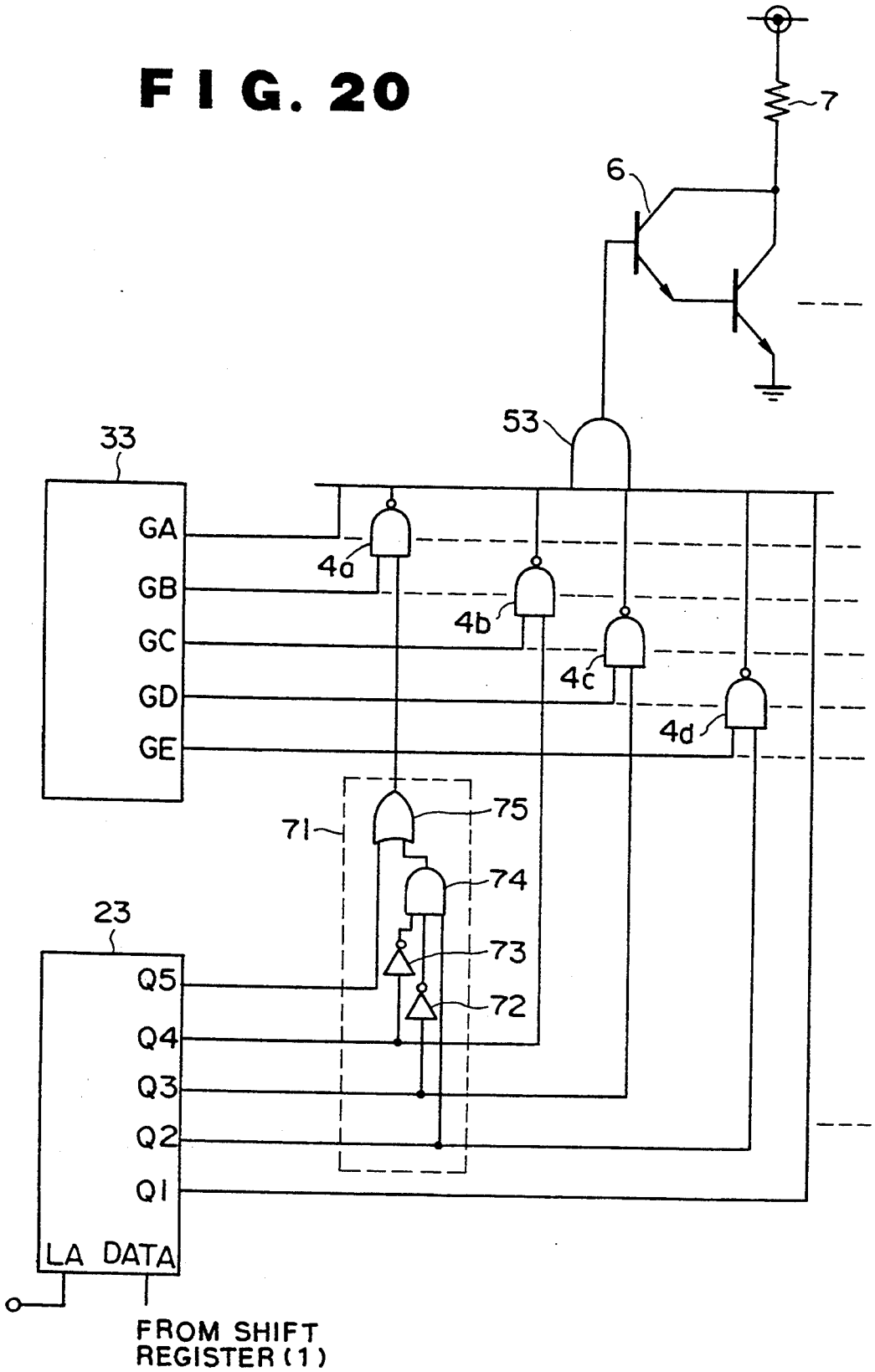
FIG. 20 is a circuit diagram showing a thermal head driving circuit according to a still further embodiment of the present invention.
Figure 21:
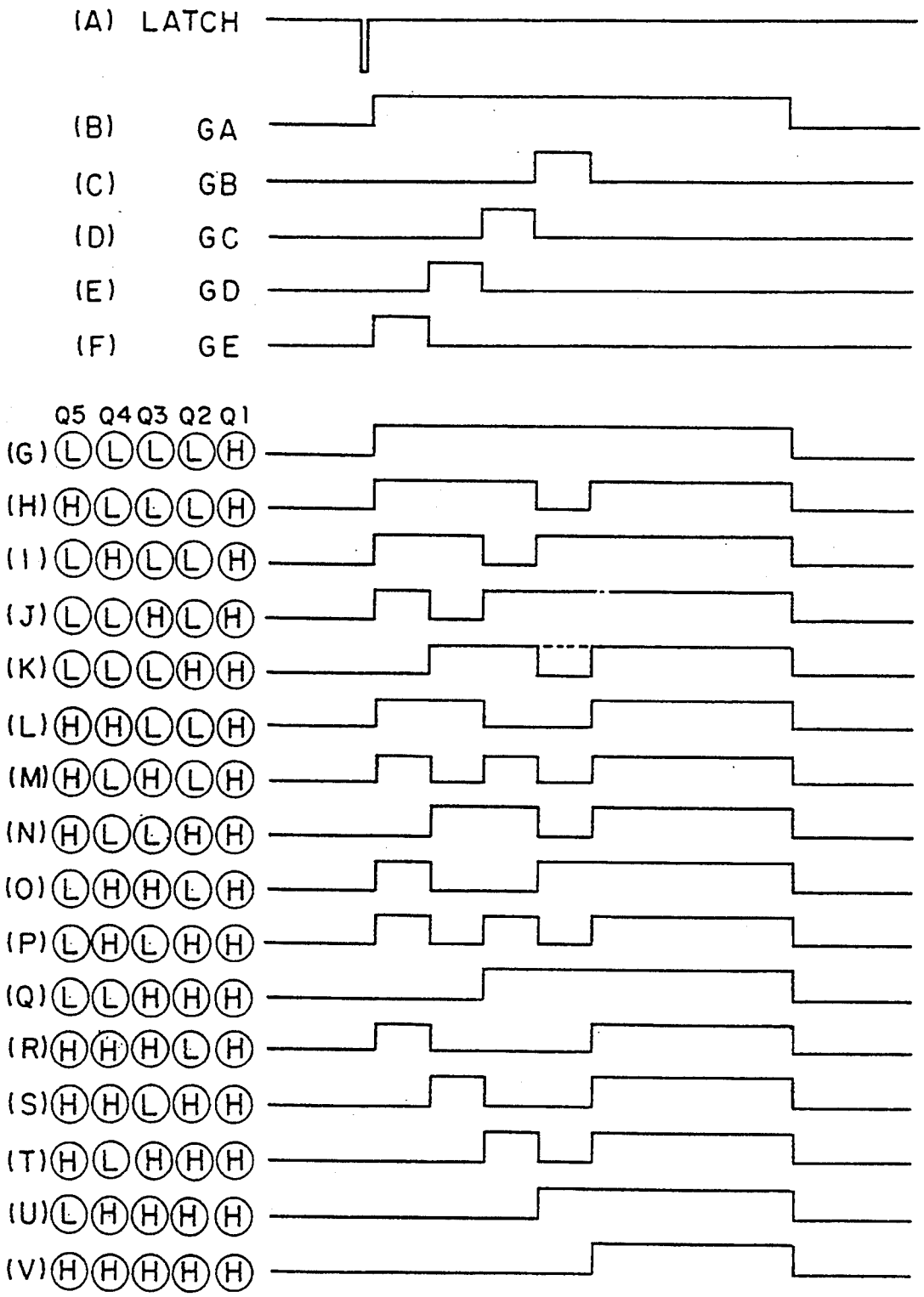
FIG. 21 is a timing chart for describing gate signals outputted from a gate signal generator employed in the thermal head driving circuit shown in FIG. 20 and outputs of each AND gate.

FIG. 20 shows a fourth embodiment in which a latch circuit 23 provided in plural form is of a five-stage arrangement. In this case, patterns, which are objects to be controlled, are divided into sixteen groups as shown in FIG. 21. Of these, the patterns in which the previous line is brought to an "H" level, are divided into eight groups. As illustrated in FIG. 21, the control for a period of a pattern shown in FIG. 21(K), which is indicated by the broken line, can be effected by inputting pattern information at the Q2 through Q5 terminals to each NAND gate 4*a* with each collating circuit 71 during a period in which a gate signal GB is being generated by a gate signal generator 33. Thus, the energy for printing, which originally falls under a level 2, can be changed to the printing energy which belongs to a level 3.

Incidentally, each collating circuit 71 is so constructed that the output of the Q2 terminal and outputs obtained by inverting the outputs of the Q3 and Q4 terminals with their corresponding inverters 72, 73, are supplied to an AND gate 74, and the output of the AND gate 74 and the output of the Q5 terminal are supplied to the corresponding NAND gate 4*a* through an OR gate 75.

Thus, the collating circuit 71 effects desired control only when the previous line and a line prior to the previous line are respectively "H" in level and a line before four lines as seen from the present line is "H" in level.

Embodiment 5

Figure 22:
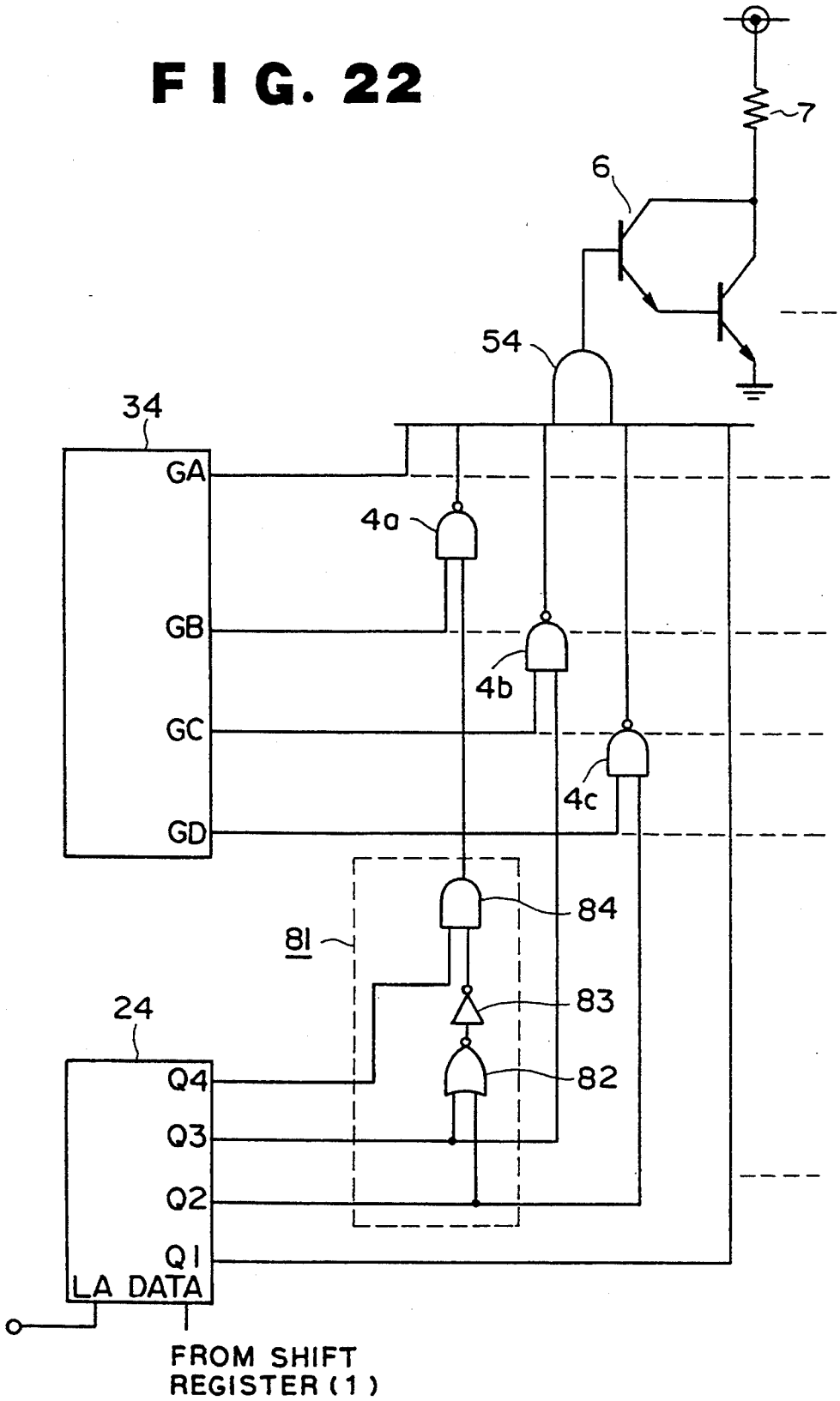
FIG. 22 is a circuit diagram illustrating a thermal head driving circuit according to a still further embodiment of the present invention.

In the above-mentioned third and fourth embodiments, the purpose of each of the collating circuits 61, 71 is to reduce the amount of generated heat with respect to each of specific patterns. However, in the present embodiment, a collating circuit for increasing the amount of generated heat with respect to each of the specific patterns will be described below contrary to the above description. Referring now to FIG. 10, the level 1 and the level 2 are identical in point number indicative of the increase in temperature to each other. Therefore, if a heat-increasing collating circuit 81 is additionally provided as shown in FIG. 22 to make the pattern (H, L, L, H) of the level 2 identical to that of the level 1, then a change in level can be effected. In this case, the normal amount of generated heat can be obtained when the Q4 terminal is "L" in level. However, when the Q4 terminal is "H" in level and the Q2 and Q3 terminals are "L" in level, an AND gate 84 is specifically closed by a NOR gate 82 and an inverter 83 of each collating circuit 81. Further, a darlington transistor 6 is turned ON so as to bring the output of each NAND gate 4*a* to an "H" level.

Embodiment 6

In the above-mentioned first through fifth embodiments, a single collating circuit, i.e., each of the collating circuits 61, 71, 81 is applied to a single driving element or device. However, the collating circuit may be used in plural form to increase specific patterns to be controlled. In the respective first through fifth embodiments, the collating circuit is electrically connected to the input of the NAND gate 4*a*. However, the collating circuit may be suitably connected to any of the NAND gates 4*b*, 4*c*, 4*d* and a combination of these NAND gates.

Embodiment 7

In the above first through fifth embodiments, each collating circuit is made up of simple gate circuits. However, the functions of these gate circuits may be effected by a delay circuit using a re-trigger circuit and an ON-OFF circuit using an analog switch.

Embodiment 8

In the above-mentioned first through fourth embodiments, the previous line is set to "H" and the lines after the previous line are set to "L" in the specific patterns. However, a desired collating circuit may be set so as to correspond to patterns, required to effect a change in level, of the specific patterns.

Embodiment 9

Each of the above first through fifth embodiments has shown a history about past three or four lines. However, a desired collating circuit may be applied to a circuit for controlling a history about past five lines or more.

Embodiment 10

In the above first through fifth embodiments, the gate signals GB through GE are identical in pulse width to each other. However, the pulse width of each gate signal may also be changed as needed to more suitably control the energization state corresponding to each pattern at each level according to each point number indicative of an increase in temperature.

When a given pulse is brought to divided pulses due to noise or the like, they are regarded as being a single pulse. Further, when small pulses which particularly do not contribute to a heat response, are produced due to the noise or the like, they are neglected. Even when each of the gate signals GA through GE is set as a train of small pulses other than a single pulse, the same effects as those described above can be obtained.

Embodiment 11

Each of the above-mentioned first through fifth embodiments shows the case where each of the latch circuits 22, 23 is provided in the form of either a four-stage arrangement or a five-stage arrangement. However, six-stage or more arrangements may also be set. Further, each embodiment also shows the case where the energization states are respectively represented by a single pulse and a plurality of pulses. However, they may be represented by a plurality of pulses and plural pulses more than or equal to the plurality of pulses.

According to one aspect of each of thermal head driving circuits illustrative of the above-described embodiments, as described above, the thermal head driving circuit is constructed in such a manner that a latch circuit for latching therein recorded information on the present line and recorded information on the previous line is set to four-stage or more configurations and the energizable state is achieved by the number of pulses corresponding to levels and the degree of an increase in temperature. Therefore, the control for recording information can be more accurately effected by increasing the number of output patterns of each latch circuit which is an object to be controlled, thereby enabling the most suitable control by less gate signals and a further reduction in printing unevenness.

According to another aspect of the thermal head driving circuit, specific output patterns produced from the latch circuit are detected, thereby controlling a gate circuit. Therefore, the amount of generated heat with respect to each of the specific patterns can be minutely controlled and a further reduction in printing unevenness can be effected.

According to a further aspect of the thermal head driving circuit, a change in level of each specific pattern can be made by a corresponding collating circuit, thereby making it possible to accurately control the amount of the generated heat with respect to each specific pattern and enabling a further reduction in the printing unevenness.

According to a still further aspect of the thermal head driving circuit, the amount of the generated heat with respect to each specific pattern can be reduced. Therefore, when a pattern corresponding to data to be printed, on the previous line, for example, is selected, the printing unevenness produced due to the thermal inertia thereof can be removed.

According to a still further aspect of the thermal head driving circuit, the amount of the generated heat with respect to each specific pattern can be increased by a corresponding collating circuit, thereby enabling a change in level of each output pattern and a further reduction in the printing nonuniformity.

According to a still further aspect of the thermal head driving circuit, a corresponding collating circuit can be used for each specific pattern at the time that the previous line is "H" in level, thereby making it possible to remove the printing unevenness developed owing to the thermal inertia of the previous line by printing.

Embodiment 12

Figure 23:
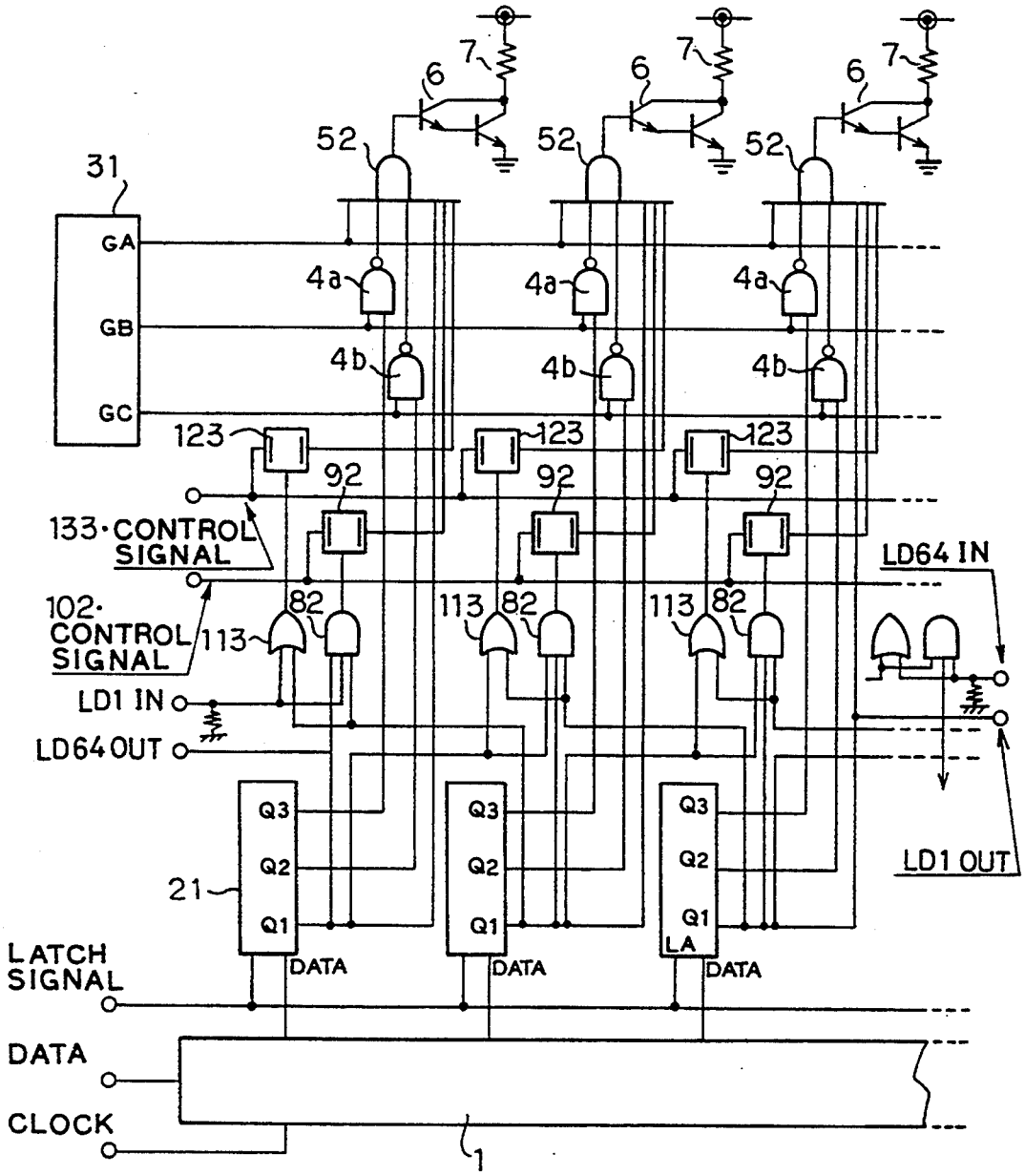
FIG. 23 is a circuit diagram depicting a thermal head driving circuit according to a still further embodiment of the present invention.

A description will be made below of a twelfth embodiment illustrative of a thermal head driving circuit for controlling each thermal or heating resistor based on the states of the adjacent thermal resistors. In FIG. 23, an LD1IN is an input terminal for receiving adjacent recorded information supplied from the outside. An LD64IN is also an input terminal for receiving adjacent recorded information supplied from the outside. An LD1OUT is an output terminal for outputting adjacent recorded information to the outside. An LD64OUT is also an output terminal for outputting adjacent recorded information to the outside. Designated at numeral 133 is a control signal, which is input to an analog switch 123 as a predetermined pulse signal. Incidentally, the same elements of structure as those shown in FIG. 23 are identified by like reference numerals and the description of common elements will therefore be omitted.

In the present embodiment, a single unit of a configuration or formed circuit is made up of 64 electrical components. Thus, the boundaries are formed at the 64th component and the 1st component. Since the configuration or formed circuit is normally set in plural form, a number of boundaries are produced. On the other hand, the boundaries are formed at both ends at which a plurality of configuration or formed circuits are connected to one another. However, terminal processing can be effected on the boundaries.

The operation of the above embodiment will now be described below. Described specifically, dual control signals 102, 133 are used to control the time required to energize each thermal or heating resistor. Further, the respective Q1 terminals of latch circuits 21 provided adjacent to each other are electrically connected to their corresponding AND gates 82. Furthermore, the respective Q1 terminals of other adjacent latch circuits 21 excluding the initial latch circuit 21 are electrically connected to their corresponding OR gates 113. Thus, an energization correction signal generator is provided by means of which the control signals 102, 133 can be input to their corresponding AND gates 82 through their corresponding analog switches 92, 123 opened and closed in response to the outputs of the AND gates 82 and OR gates 113.

While each analog switch 92 is being turned on, the control signal 102 is supplied to the gate circuit 52. Therefore, when recorded information on the present line and adjacent bit information, are both "H" in level, the energization of each thermal resistor is completed in a pulse width shorter than the normal maximum pulse width of a gate signal GA produced from a gate signal generator 31.

During a period in which each analog switch 123 is being turned on, the control signal 133 is supplied to each gate circuit 52. Therefore, when either one of recorded information on the present line and information represented in the form of corresponding bits, which is adjacent to the recorded information, is "L" in level, the energization of each thermal resistor 7 is effected in a pulse width shorter than that of the gate signal GA.

Figure 24:
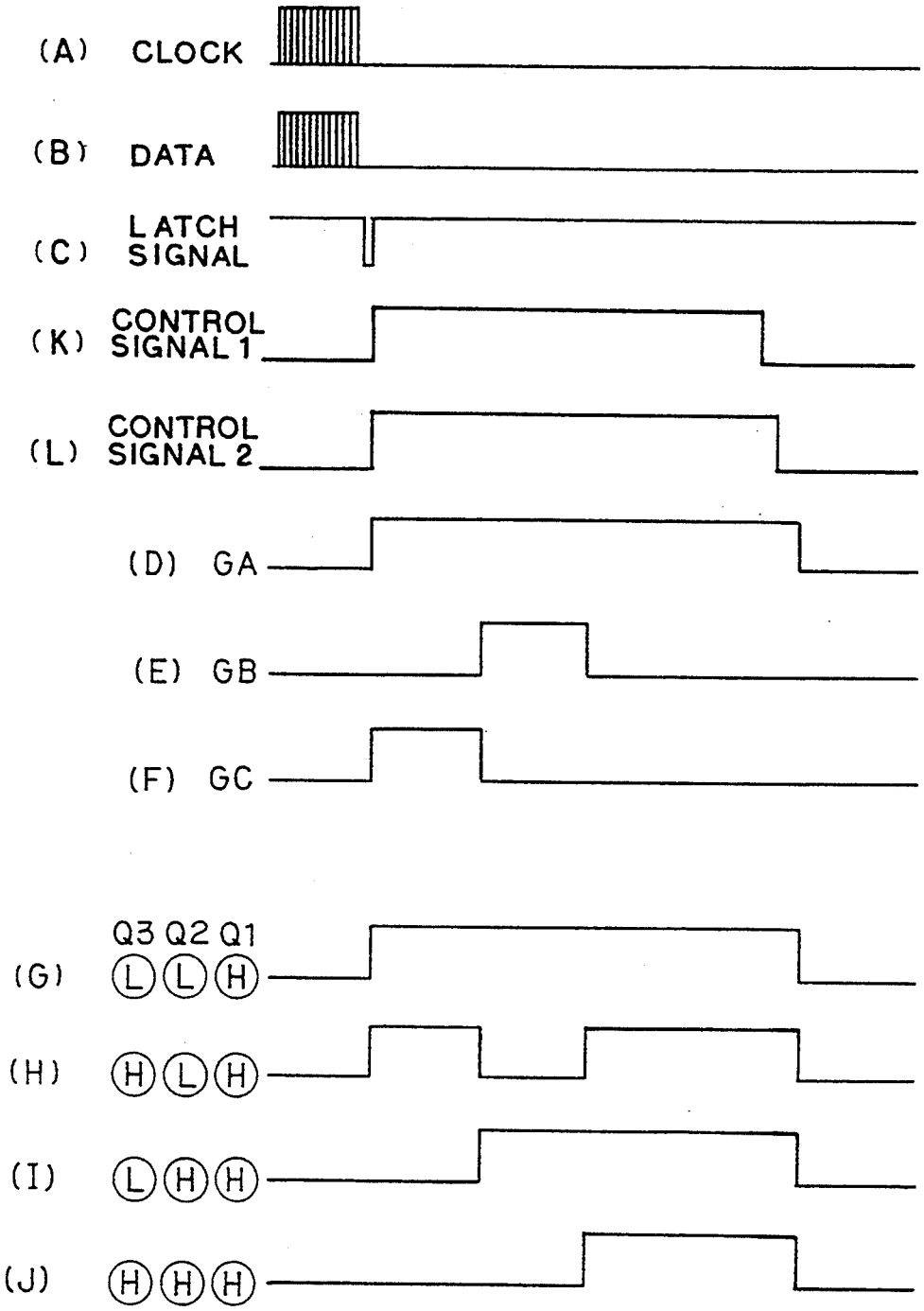
FIG. 24 is a timing chart for describing signals which appear at respective parts of the thermal head driving circuit shown in FIG. 23.

FIG. 24 is a timing chart for describing timing relationships between time intervals required to set, i.e., make the control signals 102, 133 and the gate signals GA, GB, GC of the gate signal generator 31 active. The rising of each control signals 102, 133 and that of the gate signal GA are the same. However, the time intervals required to make the control signals 102, 133 and the gate signal GA active completely elapse in that order.

That is, these time intervals are respectively associated with 280° C., 265° C. and 250° C. each of which represents the temperature of heat generated by each thermal resistor associated with the adjacent bits shown in FIG. 8. When the generated heat is high in temperature, each time interval referred to above is reduced. In the present embodiment, the time interval required to set each signal is determined so as to correspond to 250° C. or so.

Embodiment 13

Figure 25:
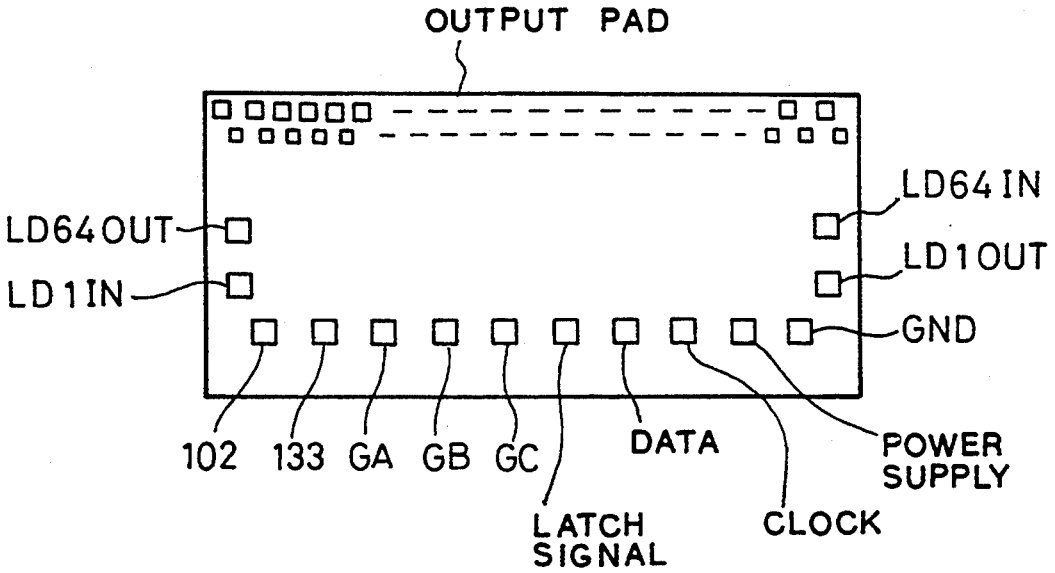
FIG. 25 is a layout drawing of a semiconductor pad for the thermal head driving circuit according to the present invention.

FIG. 25 shows the outline of a semiconductor chip which constitutes a recording head driving circuit. In this case, a pad for inputting and outputting adjacent recorded information is provided. A plurality of semiconductor chips are normally provided side by side. Therefore, in the present embodiment, an LD1IN and an LD1OUT, and an LD64IN and an LD64OUT are respectively suitably connected to each other by wire boding or face-down boding. Further, the LD1IN and the LD64OUT are provided so as to be adjacent to each other and the LD64IN and the LD1OUT are provided adjacent to each other. Furthermore, a plurality of semiconductor chips can be easily connected to one another when being arranged side by side, by disposing respective groups of LD64INs and LD64OUTs in positions opposite to those where respective groups of LD1INs and LD1OUTs are located. In the present embodiment as well, 64 circuit components are combined into a single unit. Therefore, pads for inputting and outputting adjacent recorded information are provided so as to correspond to the 64th and 1st components. Further, input signal units are provided with their corresponding pull-down resistors. These resistors are provided based on the following reasons. That is, the boundaries at both ends of a plurality of mutually-connected semiconductor chips remain as they are and recorded information located at the outsides beyond the boundaries is "L" (white) in level. It is thus necessary to effect a terminal process on the boundaries. In doing so, printing control can be effected on the whole elements or devices with high accuracy.

Embodiment 14

In the present embodiment, two control signals are used. However, a single control signal may be used. Alternatively, three control signals may be used. Further, logic for inputting and outputting adjacent recorded information is constructed by using AND gates and OR gates. However, it may be constructed by means of other gates, switches, gate arrays, etc. because only the logic is in question.

Embodiment 15

The present embodiment describes adjacent information at the boundary related to information on the Q1 terminal, i.e., the present line. However, adjacent information on a plurality of past lines including a line prior to the previous line and past lines or including the present line may be constructed by signals used to input and output adjacent information at the boundaries.

Embodiment 16

In the present embodiment, pull-down resistors are electrically connected to their corresponding terminals for inputting adjacent recorded information at the boundaries. However, they can be used even if they are not functionally operated.

According to the above-mentioned embodiments, data about adjacent recorded information can be input even to both ends of each constructed circuit, thereby making it possible to record images with high accuracy and high quality.

Having now fully described the invention, it will be apparent to those skilled in the art that many changes and modifications can be made without departing from the spirit or scope of the invention as set forth herein.

What is claimed is:

1. A thermal head driving circuit for energizing a plurality of thermal resistors corresponding to a plurality of dots to thereby control a thermal head for printing data on a heat-sensitive paper, comprising:

a plurality of latch circuits each of which retains therein recorded thermal resistor energization information for respective dots on a present line of a plurality of dots and previously recorded thermal resistor energization information for said respective dots for previous lines of said respective dots and which outputs a plurality of signal patterns indicative of said recorded thermal resistor energization information for said present line and said previous lines of said respective dots on a time-series basis;

a pulse signal generator for generating a plurality of pulse signals for controlling the states of energization of said thermal resistors according to said signal patterns and for outputting pulse signals falling within selected different level ranges for energizing said thermal resistors, at least some of said different level ranges including different reference levels of increase in temperature for said thermal resistors, which reference levels of increase in temperature are the same in at least some of said different level ranges;

said pulse signal generator including means for increasing the number of pulses with respect to patterns falling under a higher level range when the selected reference levels of increase in temperatures of said thermal resistors under different level ranges are the same; and a plurality of driving elements for energizing said thermal resistors based on the pulse signals outputted from said pulse signal generator.

2. A thermal head driving circuit according to claim 1, wherein said pulse signal generator generates pulse signals having an increased number of pulses when patterns falling under the same level range, of said plurality of patterns and having low degrees of increases in temperatures of said thermal resistors are selected.

3. A thermal head driving circuit according to claim 1, further including:

a plurality of pattern collating circuits each used for detection of whether or not predetermined patterns of patterns outputted from one of said latch circuits have been outputted; and a plurality of signal changing circuits each used to change a pulse signal supplied to each of said driving elements based on the detection by said one pattern collating circuit and the pulse signals outputted from said pulse signal generator.

4. A thermal head driving circuit according to claim 3, wherein each of said pattern collating circuits and each of said signal changing circuits are constructed so as to change a pattern which falls under a certain level range to a signal which falls under another level.

5. A thermal head driving circuit according to claim 3, wherein each of said pattern collating circuits and each of said signal changing circuits are constructed so as to increase the amount of heat generated by one of said thermal resistors upon detection of a predetermined pattern.

6. A thermal head driving circuit according to claim 3, wherein each of said pattern collating circuits and each of said signal changing circuits are constructed so as to decrease the amount of heat generated by said one thermal resistor when a predetermined pattern is detected.

7. A thermal head driving circuit according to claim 3, wherein said predetermined patterns are defined as patterns which have been printed by data on at least a line prior to the present line.

8. A thermal head driving circuit for energizing a plurality of thermal resistors corresponding to a plurality of dots to thereby control a thermal head for printing data on a heat-sensitive paper, comprising:

a plurality of units of latch circuits provided so as to be associated with said plurality of dots and each of which retains therein recorded thermal resistor energization information for respective dots on a present line of a plurality of dots and previously recorded thermal resistor energization information for said respective dots for previous lines of said respective dots and which outputs a plurality of signal patterns indicative of said recorded thermal resistor energization information for said present line and said previous lines of said respective dots on a time-series basis;

each of said units comprising a pulse signal generator for generating a plurality of pulse signals for controlling the states of energization of said thermal resistors according to said signal patterns;

each of said units further comprising an energization correction signal generator for generating an energization correction signal with respect to selected dots which are other than dots at both ends of said units on the basis of recorded information for said selected dots and recorded information for dots on the present lines of latch circuits corresponding to two adjacent dots, and for generating an energization correction signal with respect to each of said dots at both ends of said unit on the basis of both recorded information for adjacent dots on the present lines of latch circuits and recorded information for dots on the present line of a latch circuit at the ends of other units; and a plurality of driving elements for energizing said thermal resistors based on the pulse signals outputted from said pulse signal generator and the energization correction signal outputted from said energization correction signal generator.

9. A thermal head driving circuit for energizing a plurality of thermal resistors corresponding to a plurality of dots to thereby control a thermal head for printing data on a heat-sensitive paper, comprising:

a plurality of units of latch circuits provided so as to be associated with said plurality of dots and each of which retains therein recorded thermal resistor energization information for respective dots on a present line of a plurality of dots and previously recorded thermal resistor energization information for said respective dots for previous lines of said respective dots and which outputs a plurality of signal patterns indicative of said recorded thermal resistor energization information for said present line and said previous lines of said respective dots on a time-series basis;

each of said units comprising a pulse signal generator for generating a plurality of pulse signals for controlling the states of energization of said thermal resistors according to said signal patterns;

each of said units further comprising an energization correction signal generator for generating an energization correction signal with respect to selected dots which are other than dots at both ends of said units on the basis of recorded information for said selected dots and recorded information for dots on the present lines of latch circuits corresponding to two adjacent dots, and for generating an energization correction signal with respect to each of said dots at both ends of said unit on the basis of both recorded information for adjacent dots on the present lines of latch circuits and signals supplied to said unit from an external source; and a plurality of driving elements for energizing said thermal resistors based on the pulse signals outputted from said pulse signal generator and the energization correction signal outputted from said energization correction signal generator.

10. A thermal head driving circuit according to claim 9, wherein said plurality of latch circuits, said pulse signal generator, said energization correction signal generator, and said driving elements are fabricated in the form of a single chip and respectively have input terminals for inputting the signals supplied from the outside.

11. A thermal head driving circuit according to claim 10, wherein said plurality of latch circuits, said pulse signal generator, said energization correction signal generator and said driving elements respectively have output terminals for outputting recorded information formed of dots on the present lines of the latch circuits corresponding to the dots at both ends.

* * * * *

UNITED STATES PATENT AND TRADEMARK OFFICE

CERTIFICATE OF CORRECTION

PATENT NO. : 5,444,464

DATED : August 22, 1995

INVENTOR(S) : Takafumi Endo

It is certified that error appears in the above-indentified patent and that said Letters Patent is hereby corrected as shown below:

Col. 10, line 48, after "19B" insert -- are timing charts --;
Col. 11, line 10, "FIG. 19" should be -- FIGS. 19A and 19B --;

Signed and Sealed this

Eleventh Day of June, 1996

*Attest:*

*Attesting Officer*

BRUCE LEHMAN

*Commissioner of Patents and Trademarks*